US008890401B2

(12) United States Patent
Bailey

(10) Patent No.: US 8,890,401 B2
(45) Date of Patent: Nov. 18, 2014

(54) SOLID-STATE LUMINESCENT FILAMENT LAMPS

(75) Inventor: Edward E. Bailey, Westampton, NJ (US)

(73) Assignee: Illumination Machines, LLC, Mt. Laurel, NJ (US)

( * ) Notice: Subject to any disclaimer, the term of this patent is extended or adjusted under 35 U.S.C. 154(b) by 1518 days.

(21) Appl. No.: 12/392,901

(22) Filed: Feb. 25, 2009

(65) Prior Publication Data

US 2009/0212698 A1 Aug. 27, 2009

Related U.S. Application Data

(60) Provisional application No. 61/031,213, filed on Feb. 25, 2008.

(51) Int. Cl.

| | |
|---|---|
| ***H01K 9/00*** | (2006.01) |
| ***F21K 99/00*** | (2010.01) |
| *F21Y 101/02* | (2006.01) |

(52) U.S. Cl.

CPC ..... *F21K 9/52* (2013.01); *F21Y 2101/02* (2013.01); *F21K 9/135* (2013.01); *F21K 9/56* (2013.01)

USPC ..... 313/501; 313/502; 362/84

(58) Field of Classification Search

CPC ..... F21K 9/135; F21K 9/52; F21K 9/56

USPC ..... 313/501–502, 110, 46; 362/84, 249.02

See application file for complete search history.

(56) References Cited

U.S. PATENT DOCUMENTS

| | | | | |
|---|---|---|---|---|
| 7,915,627 | B2 * | 3/2011 | Li | 257/98 |
| 2002/0097000 | A1 * | 7/2002 | Muthu et al. | 315/169.3 |
| 2005/0253113 | A1 * | 11/2005 | Letz et al. | 252/301.4 P |
| 2007/0221867 | A1 * | 9/2007 | Beeson et al. | 250/487.1 |

* cited by examiner

*Primary Examiner* — Karabi Guharay

(74) *Attorney, Agent, or Firm* — White-Welker & Welker, LLC; Matthew T. Welker, Esq.

(57) ABSTRACT

Traditional incandescent and halogen lamps produce a high CRI warm white light with indirect emission patterns at the cost of poor energy efficiency. This new advancement in solid-state lighting enables the production of a new solid-state filament wherein the tungsten filament is replaced with an array of high efficiency LED emitters which combine through an equiangular spiral, or t-spline/TNURCC lightpipe network to produce a single homogeneous blue light source which then pumps a luminescent filament comprised of a phosphor loaded silicone, phosphor loaded polymer, a lanthanide doped fluoro-phosphate glass, glass ceramic tape, quantum dot filled composite, or super-continuum spectrum producing photonic crystalline structure.

25 Claims, 42 Drawing Sheets

71

81

250

260

270

SOLID-STATE LUMINESCENT FILAMENT LAMPS

CROSS REFERENCE TO RELATED APPLICATIONS

This application claims priority from U.S. Provisional Patent Application Ser. No. 61/031,213, entitled "Solid-state luminescent filament lamps", filed on 25 Feb. 2008. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to LED's or light emitting diodes. More specifically, the present invention relates to a solid-state filament wherein the tungsten filament is replaced with an array of high efficiency LED emitters which combine through a lightguide injector and then convert wavelength and solid-angle distribution after passing through a luminescent cladding.

BACKGROUND OF THE INVENTION

As of 2009 GaN LED's or light emitting diodes can produce blue wavelength light at >55% wall-plug efficiency. 55-65% wall plug efficiency for the die sources refers to the production of 550-650 mW of blue light at a wavelength between 405-489 nm for every watt of electrical power. The problem with blue light emission is that the photopic efficacy spectrum requires a large amount of green light to produce luminous flux and a white spectra requires a continuous power from 380-780 nm where in light in the green-red spectrum is of highest importance in the warm white approximating the spectral distribution of a 2700-3000K planckian radiator. Down converting the blue light to yellow and red produces stokes shift quantum loss which is unavoidable. Phosphors available in the yellow, orange, and red wavelengths also incurs internal quantum efficiencies of typically 70-90%. At an operating temperature of 100 deg C. the phosphors down-convert light less efficiently through a non-radiative process known as thermal quenching.

For example the typical wavelength conversion efficiency of a red phosphor at a temperature of 115 deg C. is 78%. When combined with the internal quantum efficiency of the phosphor of at best 90% and the stokes shift conversion loss (78-82%) the typical efficiency of a blue/red conversion is approximately (0.82)*(0.9)*(0.78)=0.574 or 57%. The thermal quenching of the phosphor is most problematic when the phosphor layer is directly deposited to the die structure through an electrophoretic deposition process, or through the heat generated at the chip which reduces the wavelength conversion efficiency of a luminescent ceramic chip placed directly on the blue die emitter itself, or when the phosphor loaded silicone or epoxy surrounds the blue or UV LED emitter in the same cavity.

Several solutions have been proposed to reduce the problem of thermal quenching and phosphor scattering, including the placement of a thin layer of phosphor loaded silicone remotely from the LED light source but contained in the same LED cavity, or to introduce a dichroic mirror at the exit of a confocal-parabolic concentrator where the blue light excites the phosphor, and then the green-red light is forward reflected giving the opportunity for the back-reflected blue light to recycle and then re-excite the phosphor.

The problem with the remote phosphor methods previously proposed by others is that the layer produces a larger source thereby reducing luminance, and still backscatters light into the high index die emitter due to the unavailability of a suitable high index encapsulant to match the die structure and remotely located phosphor composite. One of the shortcomings of the dichroic mirror approach is that the reflectance and transmission efficiency is highly angle dependent, costly to implement, and not manufacturable at the volumes required for an incandescent light bulb replacement. The problem with the luminescent ceramic chip placed directly on the die emitter is that the wavelength conversion will degrade with temperature as the chip heats up. All of these prior methods have the added shortcoming of only producing light in a 180 deg hemisphere which only fills half of the solid angle of distribution produced by the household vertical filament incandescent lamp.

SUMMARY OF THE INVENTION

A novel solution is to introduce combinations of source and optical engineering innovations to decouple the blue pump light sources from the wavelength conversion elements, to homogenize and unify the individual blue sources into one source, and to pump a wavelength conversion element which is unaffected entirely by the heat of the emitters thereby producing a 22% improvement in wavelength conversion efficiency at high blue light emitter temperatures. The wavelength conversion can be summarized by a string of multipliers including (stokes shift quantum conversionloss)*(internal quantum efficiency)*(efficiency after thermal quenching).

A luminescent glass or glass-ceramic filament can improve efficiency of wavelength conversion in several ways, including the elimination of thermal quenching loss and a reduction in scattering by matching the host medium with the phosphor index of refraction. Many Pb-free glasses are available with refractive index approaching 1.8 to match that of the crystalline host materials and lanthanide dopants. Implementing the luminescent filament wavelength conversion will eliminate the thermal quenching loss producing a wavelength conversion efficiency of (0.82)*(0.9)*(1.0)=0.74. The GaN emitters themselves are relatively unaffected by operation at high junction temperature. Operating the die junctions at higher temperature allows for a reduction in the size and surface area of the thermal dissipation structures to give more room for the guidance and direction of the light through a novel optical lens system. Where space and air-flow permits larger thermal dissipation structures may be implemented.

Critical to producing an alternative to the incandescent F-12, A-19, B-10, or G-25 lamp is the efficiency of the light source, and the quality of the indirect light pattern produced through the optical system. Much of the LED lamp prior art will bundle together various components comprising a lamp including the heatsink, optical feedback control system to maintain consistent color temperature over time, communication and dimming circuitry and protocols, or LED packaging, but will largely ignore the intricacy of the optical design required to match the intensity distribution of the existing incandescent filament lamp.

Other optical designs may produce a combination direct/indirect beam pattern but only work with a single 1 Watt LED emitter. Detailed optical simulation models and measurements of common filament lamps were conducted to produce a proper optical merit function for the design of the next generation solid state lamp. Critical to its novelty is the unification of light wavelength conversion with optical lens design to produce hybrid direct/indirect intensity distribution of light pleasing to the eye.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1A:
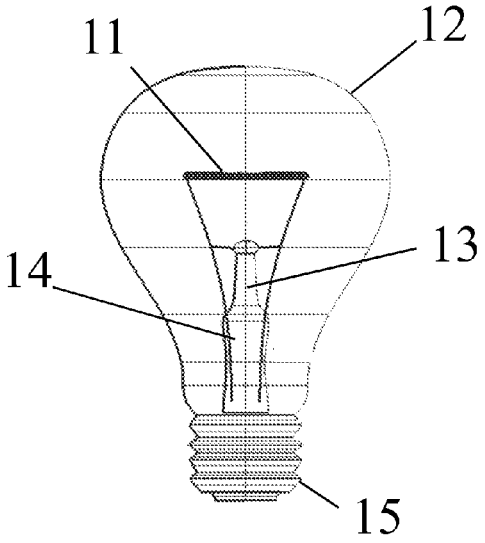
PRIOR ART Fig. 1a
FIG. 1*a*. illustrates an incandescent light bulb from IESNA lighting handbook Ver.9.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the figures, it is possible to see the various major elements constituting the apparatus of the present invention. FIG. 1 illustrates an known Incandescent light bulb 18 as taught in the IESNA Lighting handbook Ver.9. A Tungsten filament 11 *n* precise ring shape and position relative to a glass envelope shape 12. Other filament structures commonly found include a vertical coiled coil and horizontal coiled coil. The glass envelope of precise optical shape 12 is internally filled with argon to reduce tungsten deposit on the inside of the glass envelope shape 12. A Molybdenum support, glass button, exhaust hole 13 and an arbor tube and exhaust tube 14 are connected to an E26 base and contact 15 to complete the device.

Figure 1B:
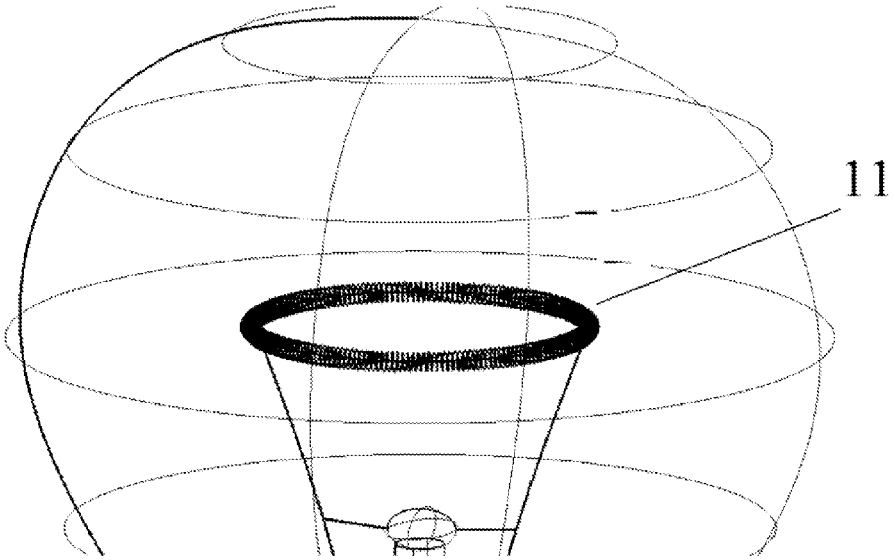
PRIOR ART Fig. 1b
FIG. 1*b*. illustrates an incandescent light bulb filament structure and shape.

The incandescent light bulb filament structure and shape 11 is shown in FIG. 1*b*. The Tungsten filament structure 11 is comprised of a ring with specific diameter, coil pitch, and approximately two meters in length, alignment of filament shape to the glass bulb geometry is critical to 3d intensity lobe shape. Luminance of the source is approximately 1.2 E5 cd/m^2.

Figure 1C:
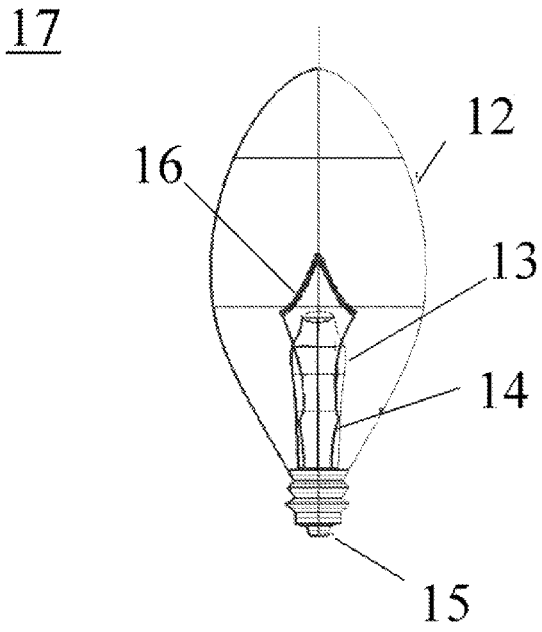
PRIOR ART Fig. 1c
FIG. 1*c*. illustrates a flame or candelabra incandescent light bulb.
Figure 1D:
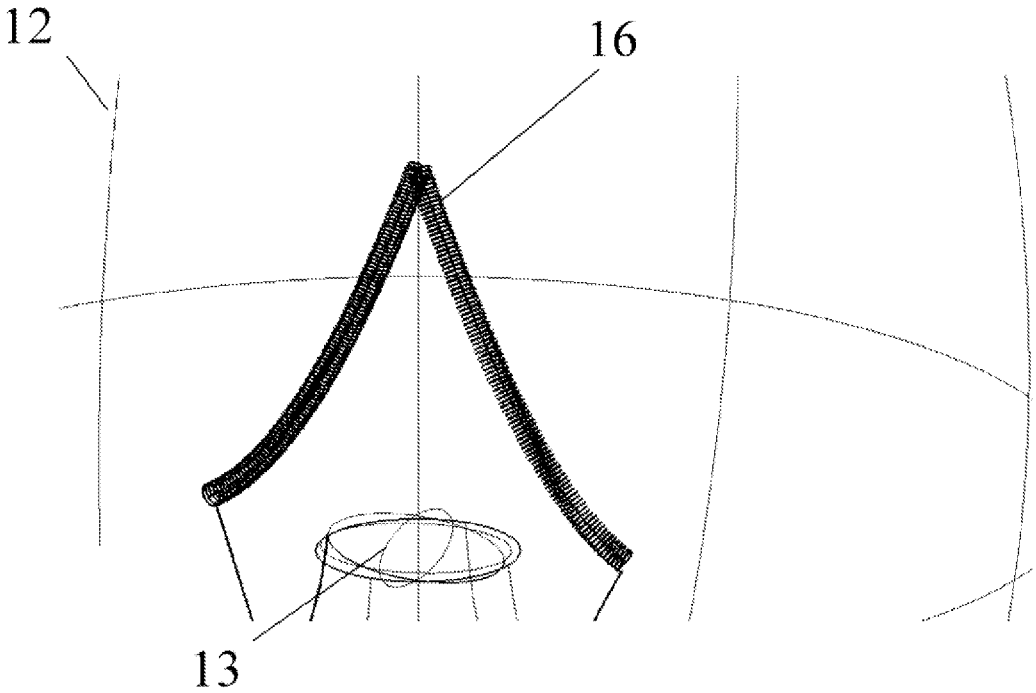
PRIOR ART Fig. 1d
FIG. 1*d*. illustrates a bulb tungsten filament structure and geometry.

Now referring to FIGS. 1*c* and 1*d*, a flame or candelabra Incandescent light bulb 17 is shown. A Tungsten filament with a peak or tent-like shape 16 with specific coil diameter, pitch, and position relative to the glass envelope 12 is shown. A Tungsten filament with a tent-like structure produces a flame intensity pattern matched to the glass envelop geometry. For the glass envelope 12 to shape light, the shield filament structure contains argon fill that prevents tungsten build up on the inside of the glass. The flame or candelabra Incandescent light bulb 17 is also comprised of an arbor, exhaust tube, glass button 13, and Arbor tube and stem 14, and E12 base and contacts 15.

Figure 1E:
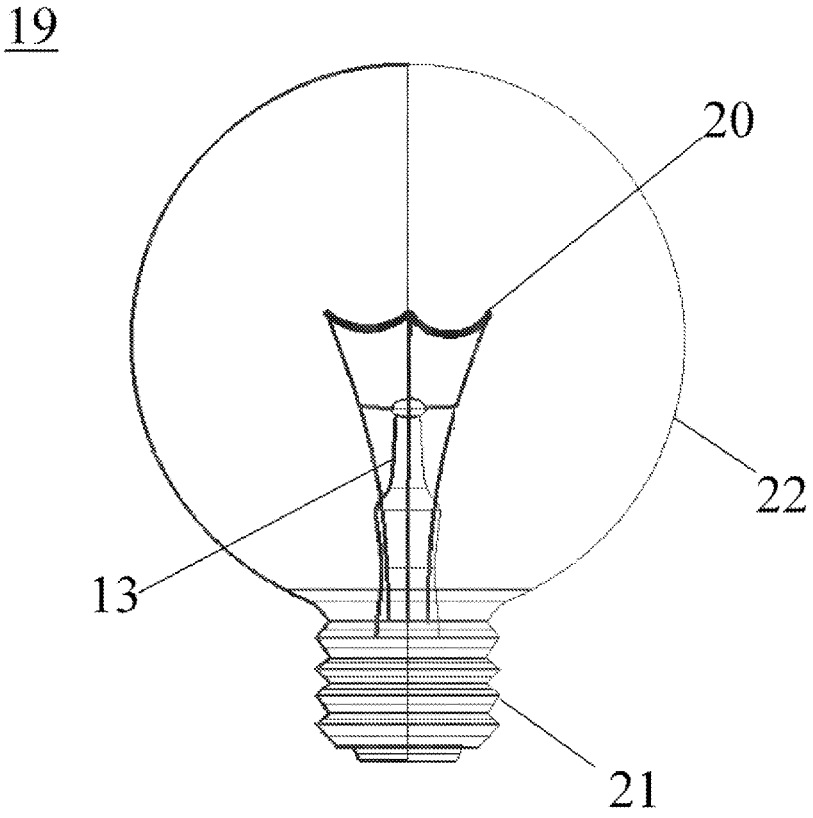
PRIOR ART Fig. 1e
FIG. 1*e*. illustrates a lamp.
Figure 1F:
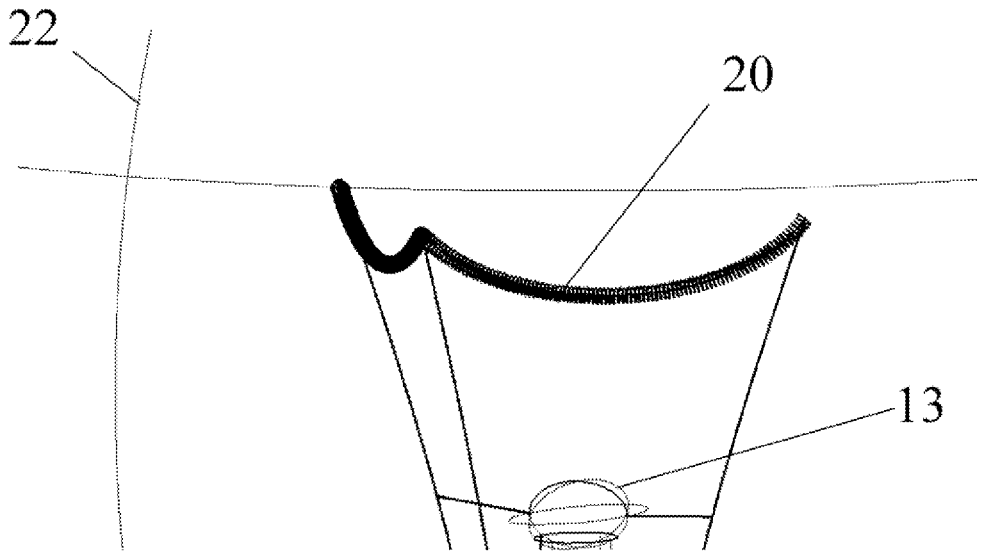
PRIOR ART Fig. 1f
FIG. 1*f*. illustrates a tungsten filament structure and geometry.

FIG. 1*e* and 1*f* illustrate a G-25 lamp 19, which is comprised of a Tungsten filament with two or three spans with specific coil radius, pitch, and shape 20, a globe glass envelope 22, a glass arbor, exhaust tube, contact wires 13, and an E26 medium base with contact 21.

Figure 1G:
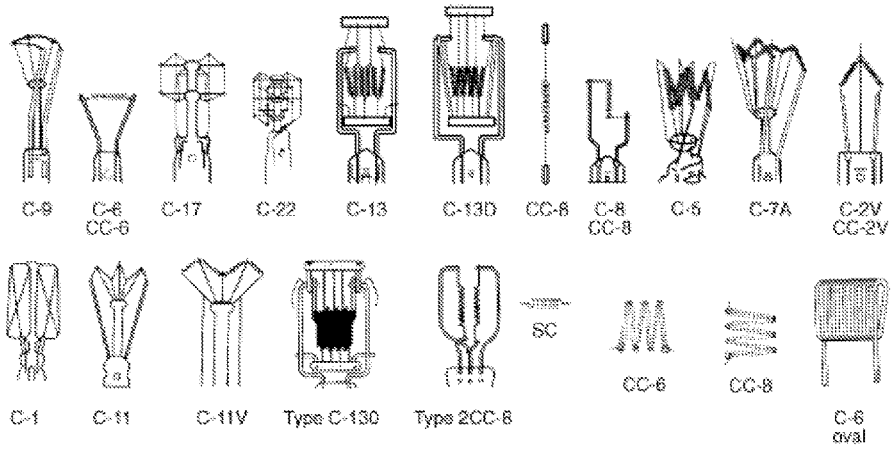
PRIOR ART Fig. 1g
FIG. 1*g*. illustrates various incandescent filament geometries.

Primarily the filament geometries C-9, C-6, C-7A, C-8, C-2V, and C-11, and C-11V, shown in FIG. 1*g*., have found the most use in incandescent bulbs used in residential lighting fixtures. The CC-6 coil is a correct representation of the fine structure of the filament in which a helical filament is then itself coiled into a global super helical structure. Many of the C-9, C-6, C-8, C-7A, C-2V could be designated CC for "Coiled Coil". This coiled coil structure further boosts luminous efficacy. The figure is included to illustrate the fine design details required to produce even a low luminous efficacy source.

Figure 2A:
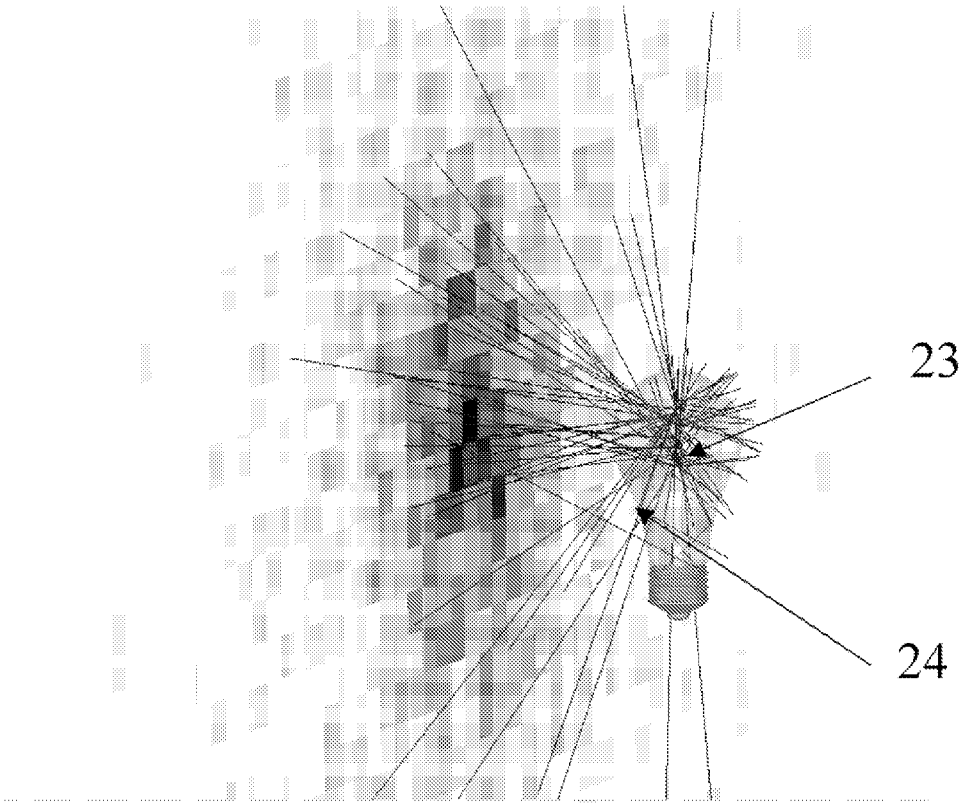
FIG. 2*a*. illustrates a raytrace and optical model of a typical vertical filament A-19 lamp.

FIG. 2*a* illustrates a raytrace and optical model of a typical vertical filament A-19 lamp. The light 21 produced from the vertical tungsten filament passes through the glass envelope to the outside. Some rays 22 within the 140-170 deg half angle zone do not pass through the glass envelope due to fresnel reflection. The illuminance distribution is portrayed on a detector screen positioned in close proximity to the lamp source.

Figure 2B:
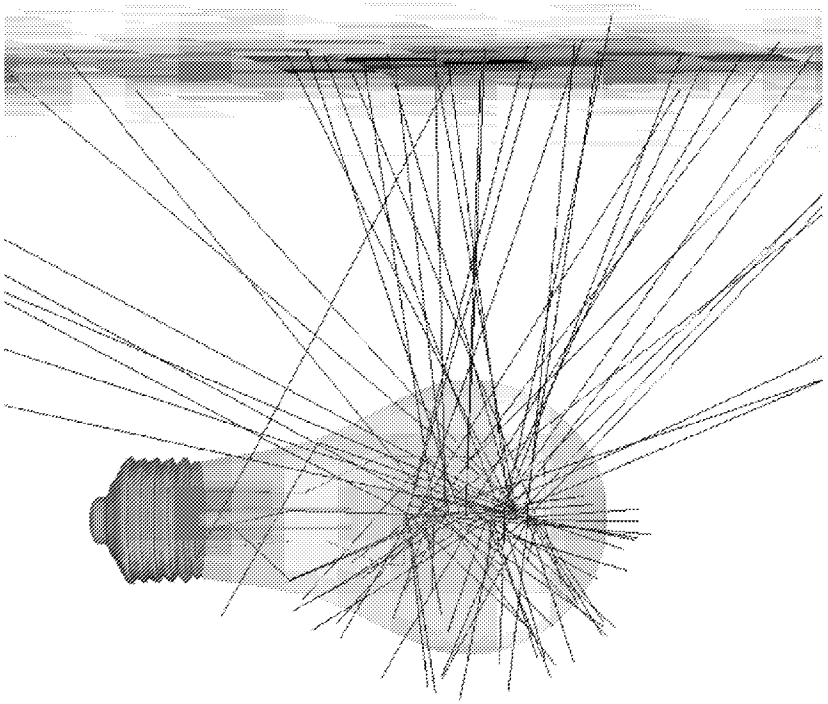
FIG. 2*b*. illustrates a lamp source model modeled including lamp structure and correct material properties.

FIG. 2*b*. illustrates an A-19 lamp source model modeled including lamp structure and correct material properties. The glass envelope 25 shown in this figure is tailored to the emission shape of light distribution as it emerges from the filament structure. Ideally the fresnel losses are kept to a minimum to allow light to exit without back reflection or tunneling of the light into the wall of the glass envelope. Reduced fresnel back reflection occurs by maintaining near normal ray incidence with the dielectric/air interface.

Figure 2C:
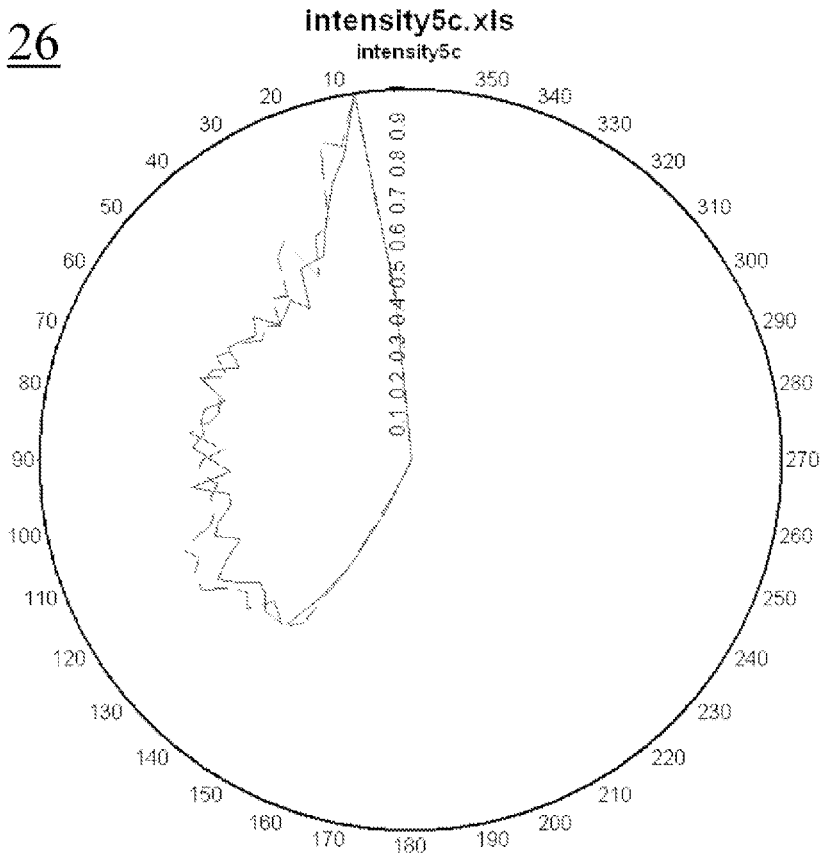
FIG. 2*c*. illustrates an intensity distribution of the vertical filament lamp of FIG. 2*a* and FIG. 2*b;*

FIG. 2*c*. illustrates the intensity distribution 26 of the vertical filament A-19 lamp of FIG. 2*a* and FIG. 2*b*. A typical filament-based bulb such as A-19, F-12, or G-25 and the similar sub-classes produce a combination direct/indirect intensity distribution in which the full-width at the field angle in which the field angle constitutes the angular dispersion at which the intensity falls off to 10% of the peak is typically 240, 280, or 300 deg full angle. Depicted in FIG. 2*c* is one half of the full intensity distribution depicting the fall-off of intensity with angular deviation from the axis directly above the bulb constituting the zero-degree reference.

Figure 3A:
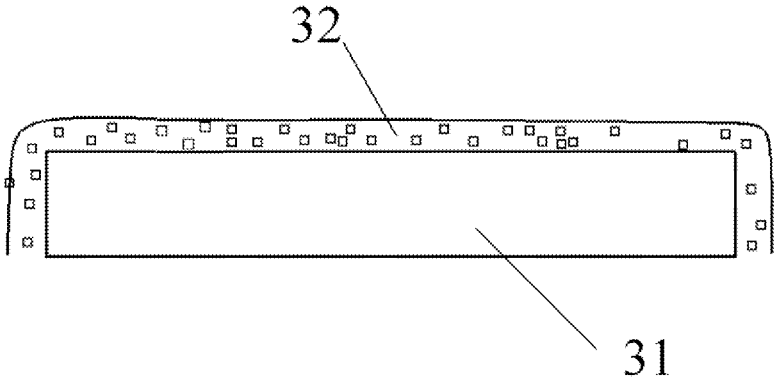
FIG. 3*a*. illustrates a wavelength conversion material directly deposited on LED emitter.

Now referring to FIG. 3*a*., wavelength conversion of material directly deposited on LED emitter 31 is shown. The LED emitter structure 31 in which the wavelength conversion layer 32 is deposited directly to the active emission structure of the device is shown. The wavelength conversion material and layer 32 operates near the temperature of the LED emitter producing inefficient conversion due to thermal quenching. Lifetime of the LED as well as white point consistency over time suffers.

Figure 3B:
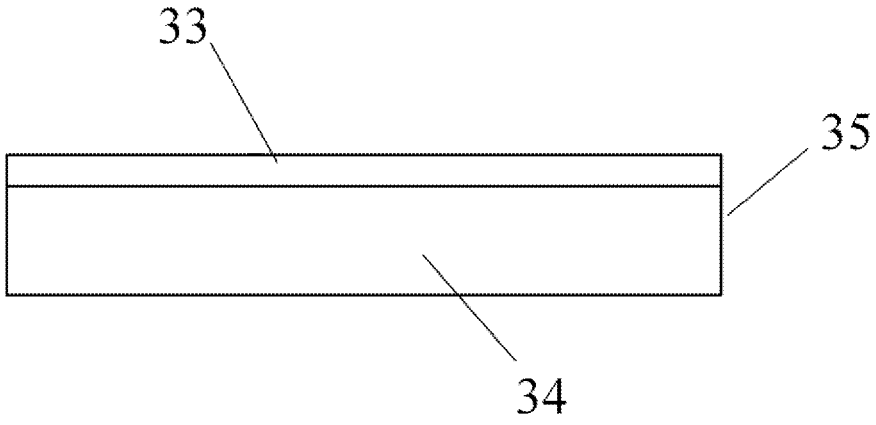
FIG. 3*b*. illustrates a wavelength conversion chip directly bonded to the active emission structure of the LED.
Figure 3C:
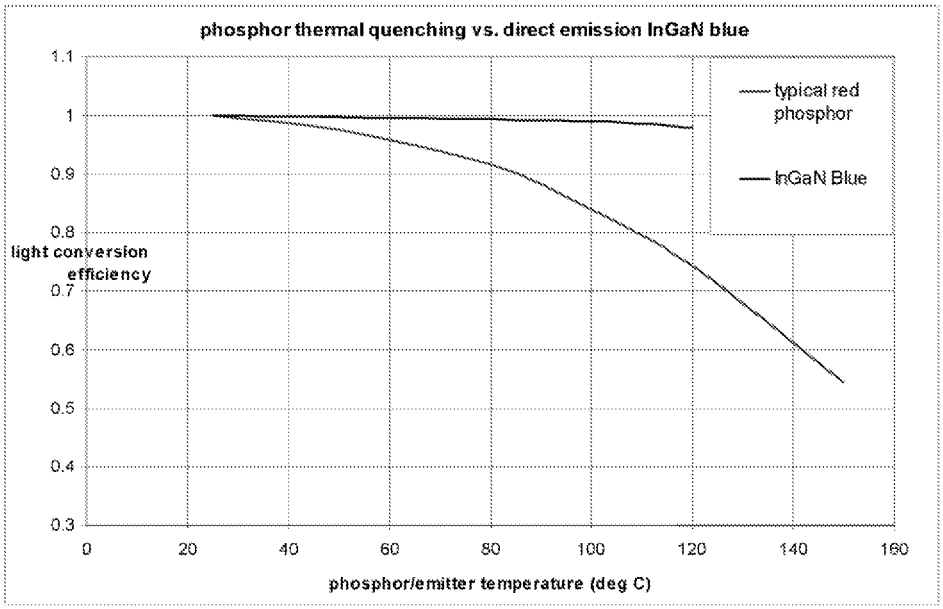
FIG. 3*c*. illustrates a light source wavelength conversion performance.

A wavelength conversion chip 33 can be directly bonded to an active emission structure 33 of the LED semiconductor or the back of the substrate material in the case of a flip-chip emitter. FIG. 3*b* shows a solid-state pump device or LED 35, where a wavelength conversion chip 33 is comprised of a luminescent ceramic tape. The luminescent ceramic performs less efficiently at high temperature, and scatters light directly into the absorbing active structure of the LED emitter 34. Some of the light is re-emitted through photon recycling but most is absorbed and lost. As shown in FIG. 3*c* typical blue LED's perform between 90-96% of radiometric power level as compared to operation at 25 deg C. Yellow-Red phosphors perform at 75% at typical operating temperatures due to thermal quenching.

Figure 4:
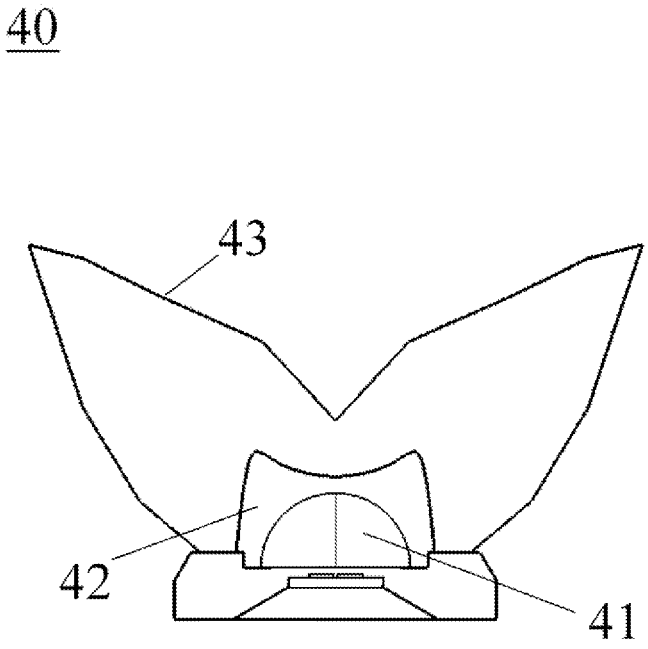
FIG. 4. illustrates a delectric/air interface losses of typical snap-on secondary optics.

FIG. 4 depicts a traditional LED package 40 in which the LED emitters are immersed in a silicone with a snap-on light redirection device. Light will trap and back reflect at the glass, silicone, or plastic hemisphere/air interface due to total internal reflection 41. Light is also back reflected and lost at the air/lens interface 42. An additional 4% of the light is lost due to internal back reflections at the exit lens/air interface 43. It is difficult to design secondary optics which are better than 88% efficient due to these three interface ray splitting losses. It would be advantageous to eliminate at least two of these three interfaces.

Figure 5:
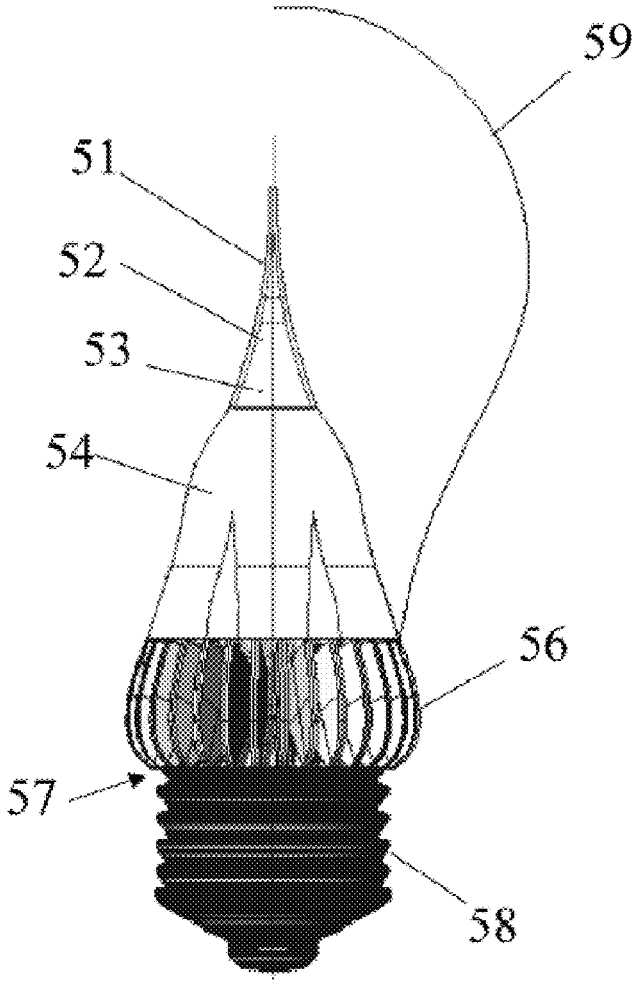
FIG. 5. illustrates a next generation solid-state luminescent glass filament lamp.

FIG. 5 depicts a solid state luminescent filament replacement for the A-19 tungsten filament bulb which has gained such prevalence over many decades. The next-generation lamp consists of a system of novel optical design elements including a b-spline, polynomial, t-spline, T-NURCC, NURBS, or NSS described combination source filament comprised of a luminescent glass such as but not limited to a fluoro-phosphate or oxy-sulphide halide glass doped with rare earths optimally combined to produce a high CRI preferably 80+ and a color temperature of 2700-3000K. The filament structure serves a dual purpose, both to convert light and to direct the light in such a manner that it matches the emission intensity profile of the tungsten A-19 lamp or G-25.

The filament structure is not limited to glass, or glass/ceramic. The filament structure may also be comprised of a loaded polymer and the wavelength conversion may also be performed through a photonic crystalline structure. Photonic crystalline structures have produced narrow to wide-spectrum behavior through strong non-linearity as used in optical coherence tomography in which the source is an ultra wide-band supercontinuum spectrum.

Such photonic crystalline wavelength conversion structures may be designed through the aid of an evolutionary optimization tool. The material of the wavelength conversion light redirection device would ideally match the wavelength conversion mechanism in the case of a rare-earth loaded polymer or glass to reduce back scattering to a minimum.

The wavelength conversion shell 51 as shown may also be described in terms of a "cladding". In which the filament structure comprised a minimum of three parts: The wavelength conversion shell 51 whose shape is specifically tailored to redirect light to match that of a indirect/direct source, the inner structure 52 is structured in thickness to maximize light transfer efficiency, wavelength conversion efficiency free from thermal quenching, and to maintain constant color temperature in the beam intensity zones as desired. The inner "core" 53 where the blue light emerges from the high efficiency lightguides tunnels, frustrates TIR and passes through the wavelength conversion shell before redirection. A lightpipe network 54 is comprised of high efficiency, low absorption glass, polymer, or photonic crystalline holey fiber structure. The waveguide must combine light from a spider of source locations, or direct and guide through high efficiency TIR the light from a central lightpipe trunk illuminated by a large emitter or emitter array capable of producing 4-5 Watts of UV-Blue light. The geometry of the lightpipe combiner 54 in which equiangular spirals are most efficient, but extended free-form t-splines, b-spline NURBS or NSS surfaces are also powerful computational geometry tools with which to combine and direct light to the central luminescent filament section.

The thermal dissipation structures 56 are required for such a lamp in which the structures may be designed through the aid of evolutionary algorithms. The thermal dissipation structures are commonly comprised of Aluminum, or Copper. Thermal dissipation required attention to detail from the Multiple-quantum wells out to the air. Structures which work well include Copper substrate die emitters, eutectic die attach, elimination of a metal core board with direct attachment to an isolated or printed heatsink interface, etc. The thermal dissipation fins should be spaced, positioned, and shaped in such a manner that junction temperatures do not exceed 100 deg C. The thermal dissipation structure may be painted black to improve radiative transfer or textured.

The lamp of the present invention requires a power electronics device 57 to convert line AC to stabilized power factor corrected DC to drive the solid-state emitter devices. The power electronic components may be arranged and designed through the aid of an evolutionary computational tool in which topology search algorithms enhanced through genetic, harmonization, or other gene expression behaviour in biology enhance the speed of global geometry discovery. In a localized case the design tools aid the selection, arrangement, and design layout. It is desired that the power transfer from line to light engine device is >99% efficient to within the spacing limitations of the lamp. Optical feedback control means may also be integrated to the power electronics cluster to avoid thermal over heating, or to tune wavelength emitters to a desired color temperature. Such optical control circuits may be designed through an evolutionary optimization tool and enhanced through neural network design methodology.

The E26 base 58, although a bi-pin base or next generation solid-state base is also possible. The envelope structure 59 is ideally tailored to reduce fresnel reflections. The envelope structure 59 may be blow molded from hard silicone, glass, or other polymers. The protective envelope structure may also contain moth eye nano-structure to drastically reduce fresnel losses at both the incident and exit surfaces. The glass or other material envelope may also be comprised of an active material as well in which "active" refers to wavelength conversion or light redirection. The extended free-form structure may be comprised ideally from T-spline geometry, T-NURCC or D-NURBS to locally design geometry which optimizes orthogonal interfacing for each ray bundle directional class.

Figure 6:
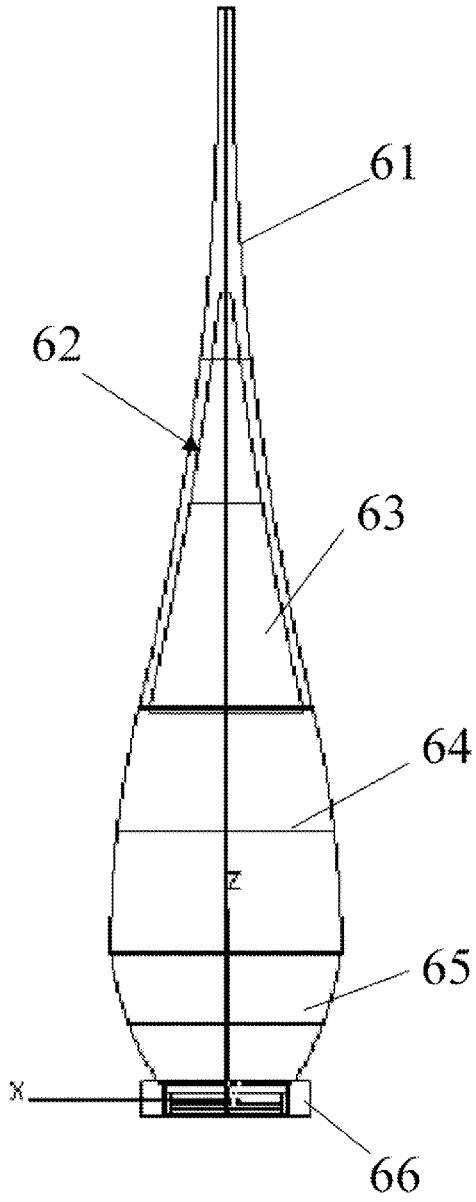
FIG. 6. illustrates luminescent filament detail1 with single trunk lightguide.

FIG. 6. illustrates the luminescent filament light redirection shape 61 used to produce an indirect/direct light intensity pattern. The luminescent filament structure wall or "cladding"62 surrounds the tapered pump "core" 63 in which frustrated TIR UV-Blue light pumps a wavelength conversion shell which itself specifically tailored to optically control light distribution. A lightpipe section 64 directs light to the luminescent filament structure. The collimation device 65 is directly coupled to the solid-state emitter or emitter array. The package 66 which encloses the emitters in which a high index encapsulant such as silicone improve external quantum efficiency. The silicone itself may be loaded with higher index nano-particles such as ZrO2, or Tantalum Pentoxide to further extract light from the emitter. The emitters may be nano-roughened or patterned with photonic crystalline structure to improve light transfer efficiency from the light emission section to the integral or monolithic lightguide.

Figure 7:
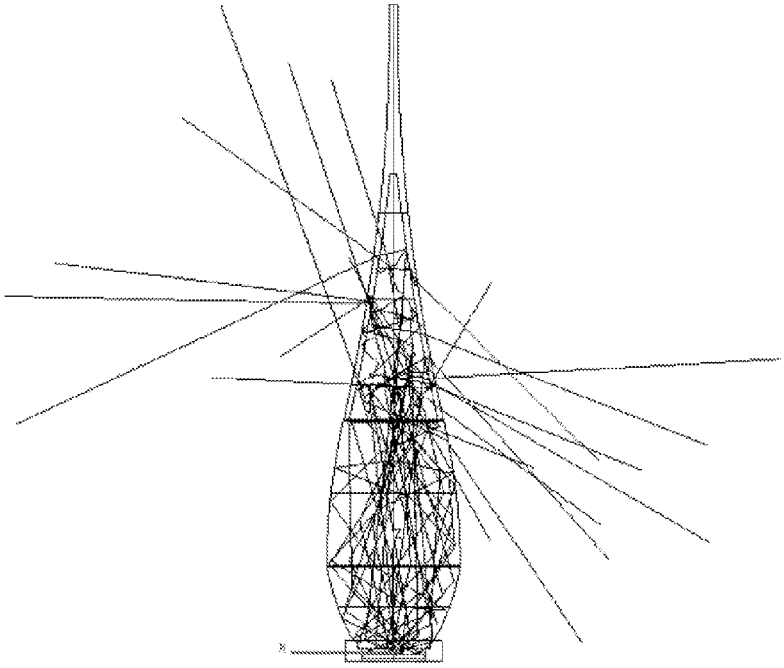
FIG. 7. illustrates a raytrace of a luminescent filament.

FIG. 7 depicts the ray tracing of the luminescent filament 71 in which ray tracing refers to the evaluation through optical physics software the active computational geometry comprising the luminescent filament structure. The luminescent structure loaded with rare-earths directs ray-paths according to the mean free-path and cross section of the particles with respect to the bulk material. An efficient TIR lightguide or holey photonic band-gap lightguide directs light from the light emission center to the wavelength conversion and optical direction device.

Figure 8:
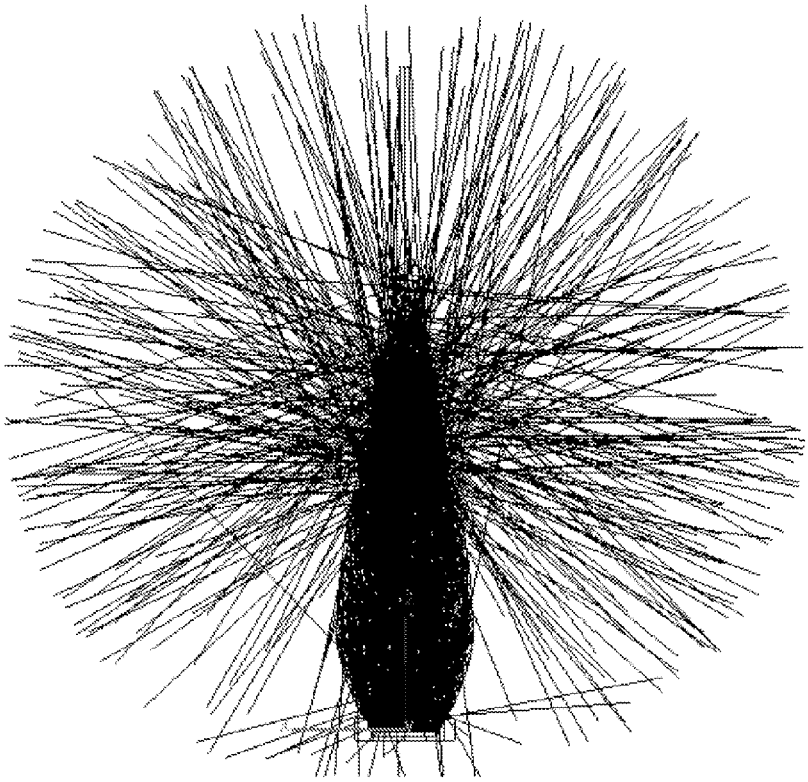
FIG. 8. illustrates a the globe of light produced through a solid-state luminescent filament system.

The globe of light produced through a solid-state luminescent filament system is shown in FIG. 8. The ray bundles 81 emerge from the luminescent filament structure. As shown a combination of direct and indirect light mimics the light emission pattern produced by a tungsten filament lamp.

Figure 9:
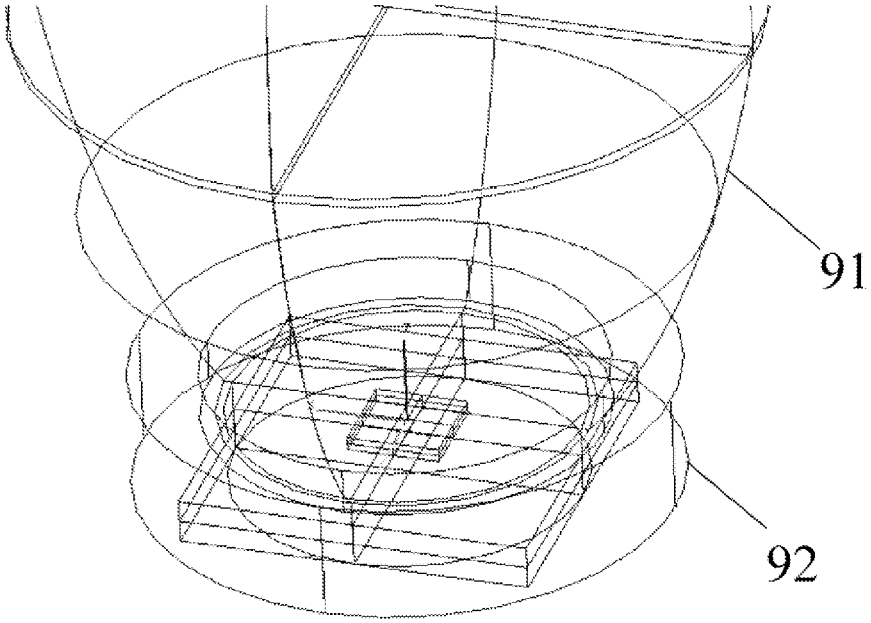
FIG. 9. illustrates a solid-state emitter coupled to a TIR lightguide.
Figure 10:
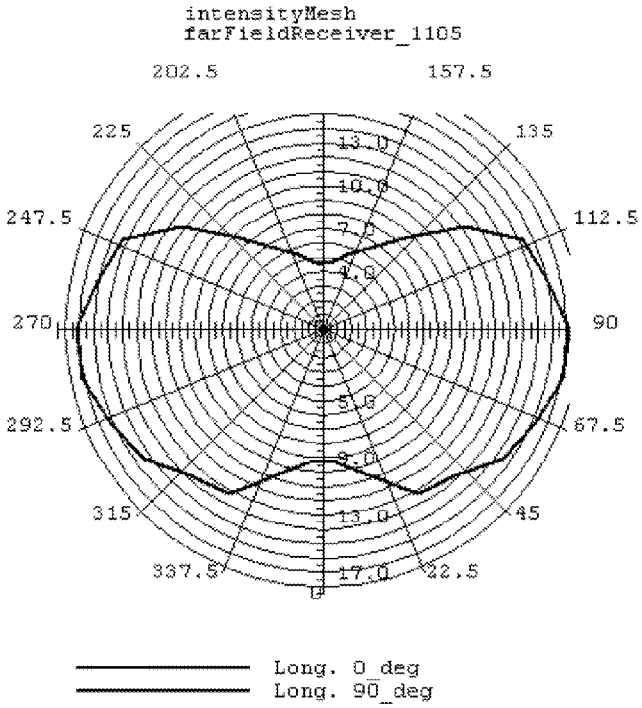
FIG. 10. illustrates an intensity pattern of the luminescent filament structure described in FIG. 7.

FIG. 9 describes the solid-state emitter package 92 coupled to a TIR lightguide 91 comprised of glass or other materials with high visible transparency. A combination of direct and indirect light verifies the operation of the luminescent filament optical structure as shown in FIG. 10

Figure 11:
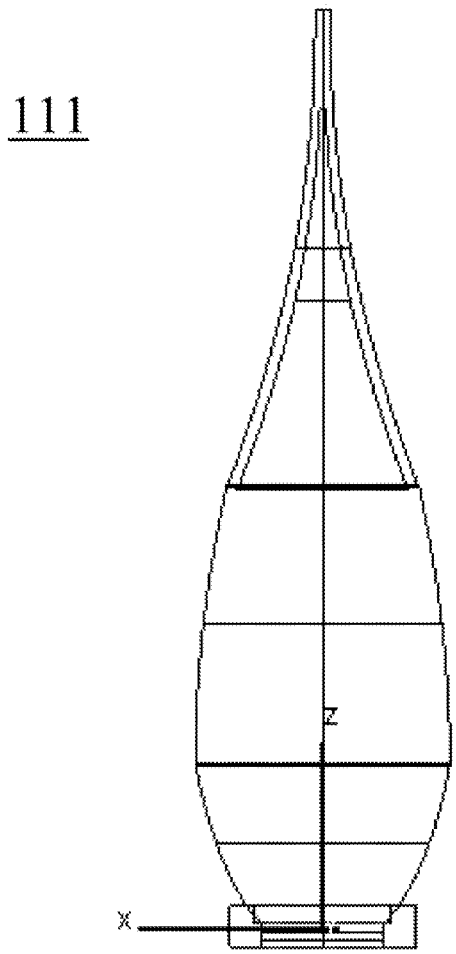
FIG. 11. illustrates a figure representing a "FlexFilament" approach to lamp design.

FIG. 11 represents a "FlexFilament" approach to lamp design. As shown in FIG. 11, t a 40% shorter luminescent filament 111 with a slightly different light redirection spline geometry is shown. The introduction of alternative luminescent filament designs allows for the production of many source lamps with custom light intensity distributions for style and aesthetic lighting design purposes.

Figure 12:
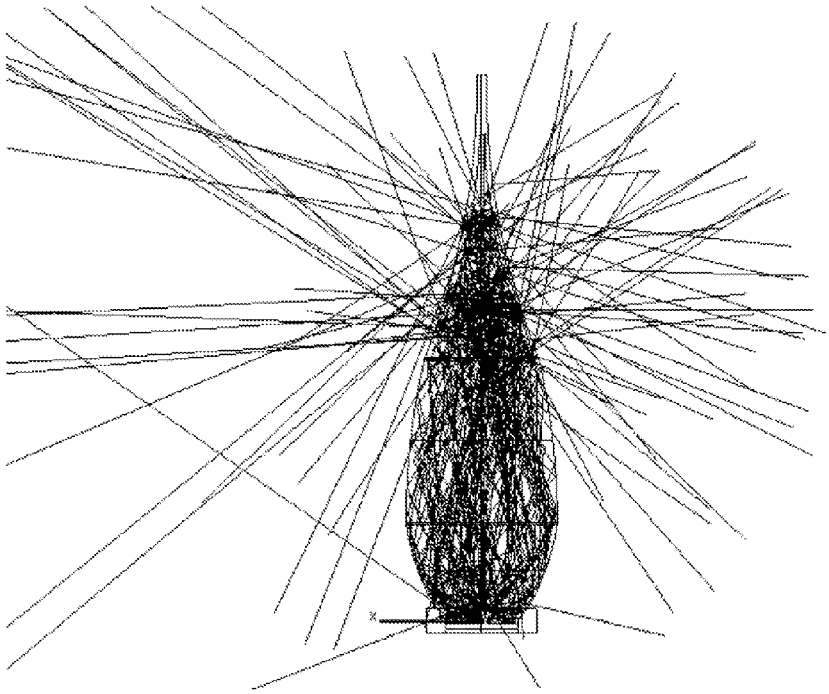
FIG. 12. illustrates a light raytrace of the luminescent filament shown in FIG. 11.
Figure 13:
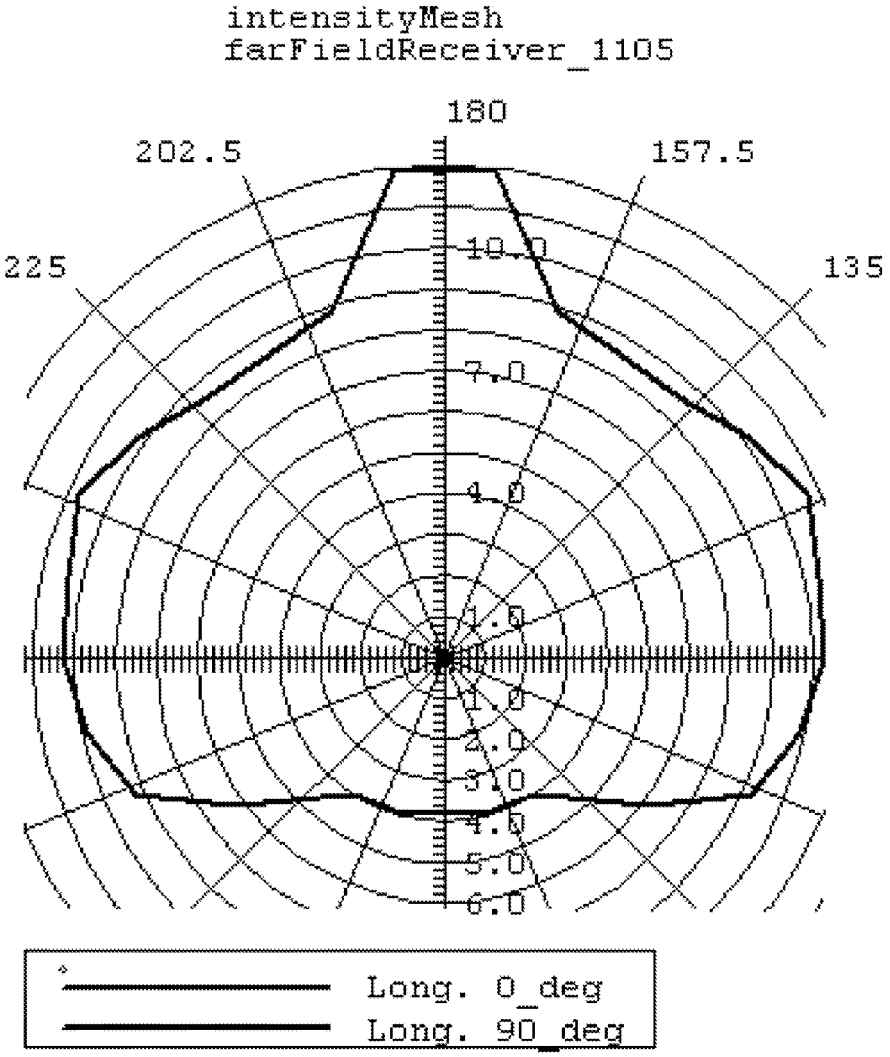
FIG. 13. illustrates an intensity distribution of the "Flexfilament" design1 of FIG. 12.

FIG. 12 illustrates the light raytrace of the luminescent filament 111 shown in FIG. 11. As shown in FIG. 13 the light distribution pattern now produces more direct light than the intensity pattern of FIG. 10. Lighting fixtures vary in their requirements and as such adjustments to the filament structure may change as required.

Figure 14:
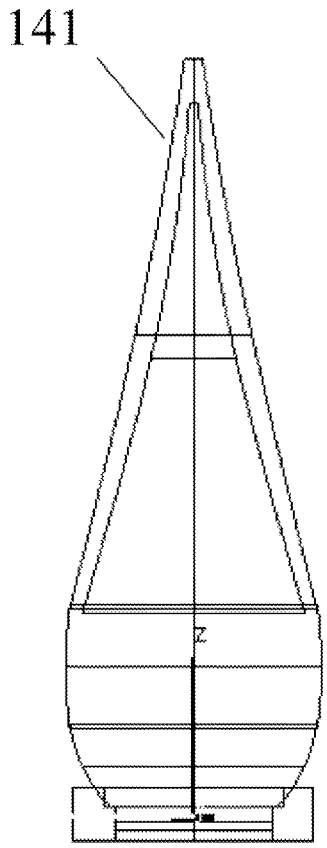
FIG. 14. illustrates a flexfilament design.

FIG. 14 describes a luminescent filament design which closely matches that of a vertical filament A-19 intensity distribution. The geometry shown includes only one central lightpipe trunk 141, and is a representation only. The central lightpipe trunk 141 may be replaced with a high efficiency lightpipe spider network in which the lightpipe channels are comprised of T-splines or extended free-form geometry or equiangular spiral described lightpipe sections which combine multiple cavities of light emitters.

Figure 15:
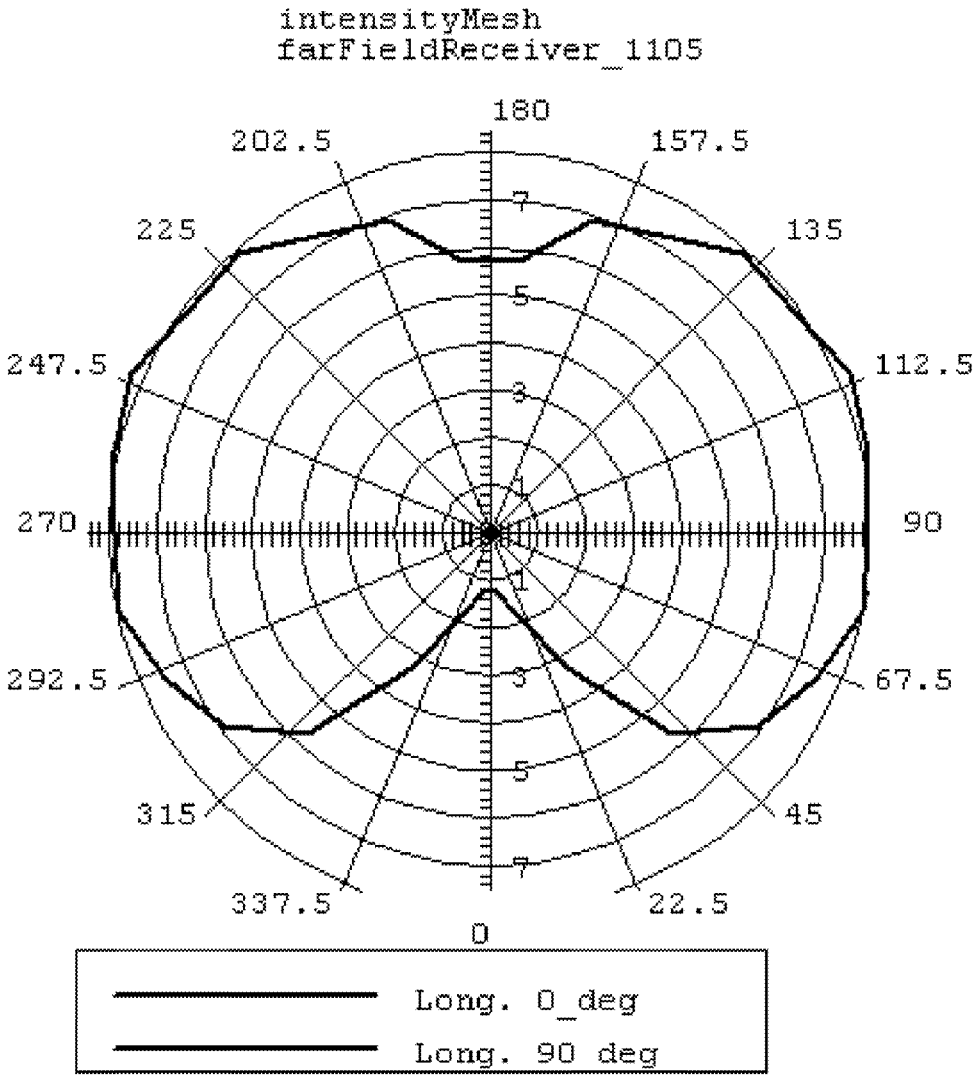
FIG. 15. illustrates a resulting intensity distribution as produced by the luminescent filament geometry depicted in FIG. 14.

FIG. 15 illustrates the resulting intensity distribution as produced by the luminescent filament geometry depicted in FIG. 14. The intensity pattern shown describes the light intensity as produced by the luminescent filament depicted in FIG. 14. The light distribution has zero degree directly below the light array source in which no light emerges through the thermal dissipation structures and the majority of the light passes to the side with a slight reduction in relative intensity at the 180 degrees intensity zone directly above the light source.

Figure 16:
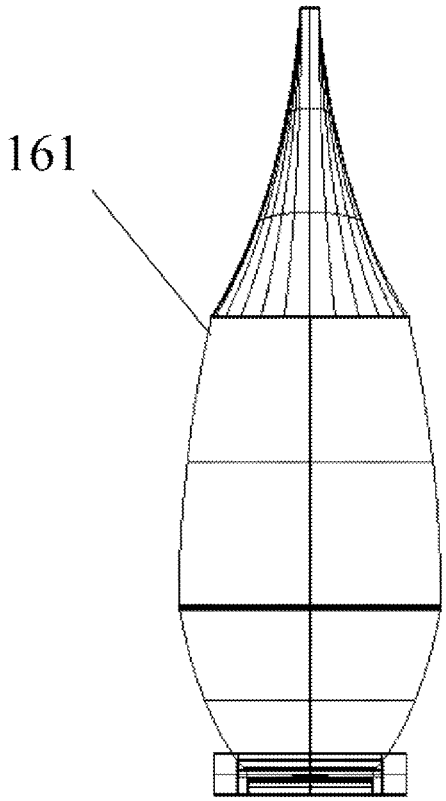
FIG. 16. illustrates an asymmetric design luminescent flex filament.
Figure 17:
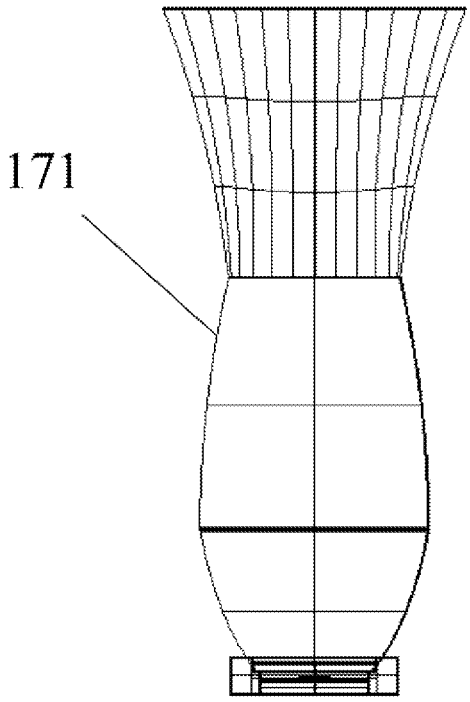
FIG. 17. illustrates an asymmetric flex filament luminescent filament.

FIG. 16 shows a luminescent flex filament with an asymmetric design. Here the ZX cross section of a luminescent filament 161 design in which the cross-sections are asymmetric produces a fan-shaped intensity distribution. FIG. 17 shows an asymmetric luminescent filament. The ZY cross section of the luminescent filament 171 design in which the cross-sections are asymmetric to produce a fan-shaped intensity distribution.

Figure 18:
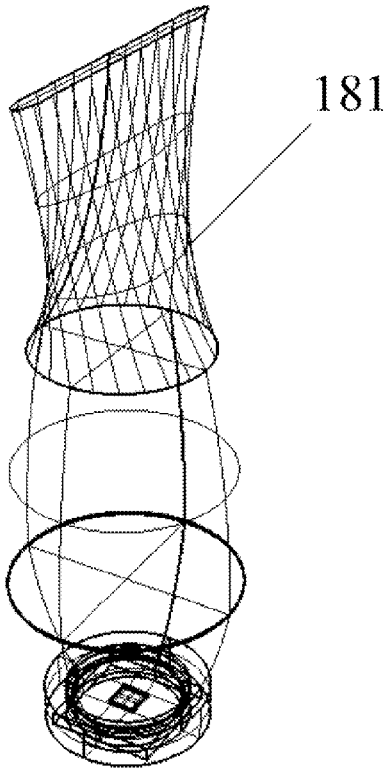
FIG. 18. illustrates a perspective view of the flex filament design.

FIG. 18 illustrates a flex filament. The Flex filament 181 in which the luminescent filament structure is asymmetric produces an intensity distribution that is wider in one cross section than the other.

Figure 19:
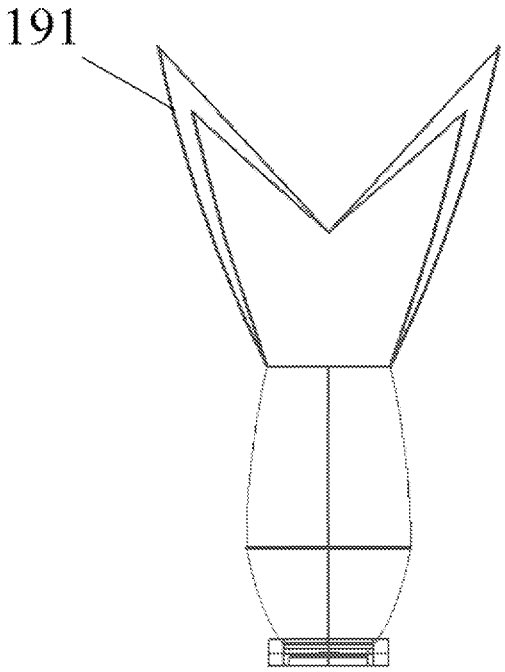
FIG. 19. illustrates a luminescent flex-filament design.

FIG. 19 discloses a luminescent flex-filament teaching a luminescent filament ring structure 191 to mimic the incandescent light source of FIG. 1*a*.

Figure 20:
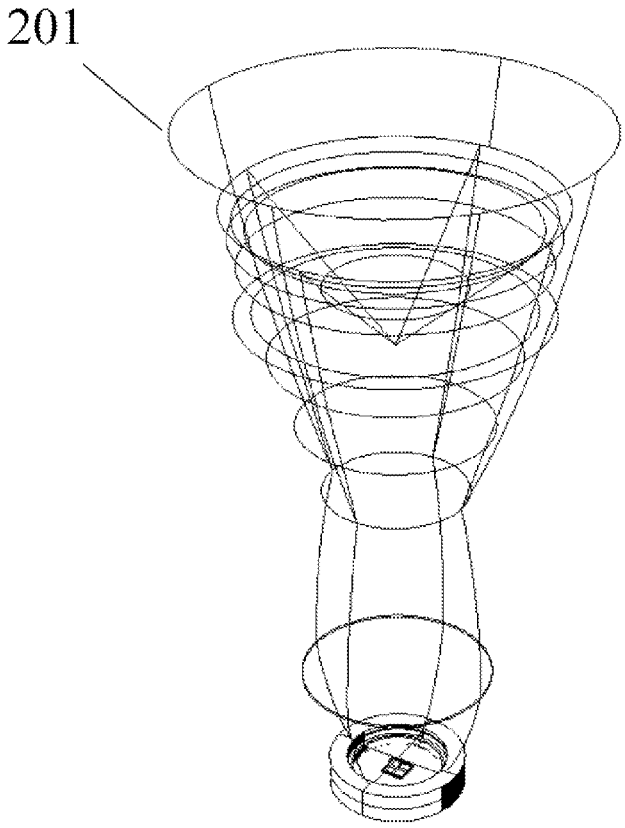
FIG. 20. illustrates a luminescent flex-filament design.

FIG. 20 discloses a luminescent flex-filament 201 in which the design structure produces an indirect/direct ring of light to mimic the light distribution pattern produced by a ring tungsten filament lamp.

Figure 21:
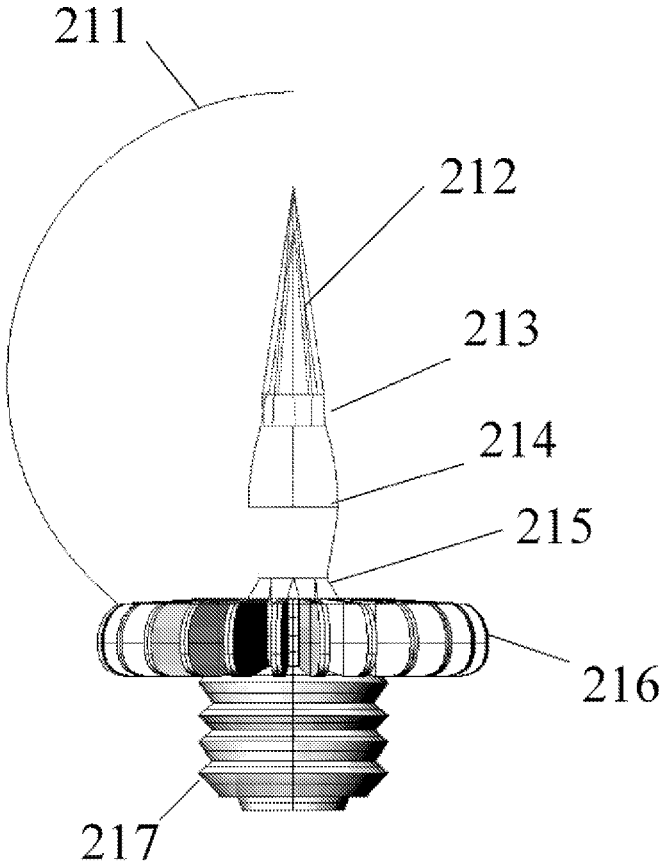
FIG. 21. illustrates a G-25 lamp incorporating the flex-filament optical system.

FIG. 21 discloses a G-25 lamp incorporating the flex-filament optical system. FIG. 21 is a depiction of the elements necessary for a next generation G-25 lamp based upon luminescent filament structure, high efficiency extended free-form lightpipes to combine and pre-process light fields before entering the wavelength conversion section and beam shaping surfaces. The outer protective envelope 211 may be manufactured from glass, optical grade polymers or silicones. The material shape may be comprised of extended free-form t-spline geometry preferably, or D-NURBS, and may be optically inactive serving only to protect the interior optical system components. When optically passive the envelopes three dimensional shape ideally produces local surface normals with respect to the incident light fields to reduce fresnel reflection losses at the interface. Surface texturing may be applied to produce a diffuse source with reduced glare and luminance as a transfer of light emission from the luminescent filament to the outer envelope structure. Scattering however is detrimental to light transfer efficiency.

The outer envelope 211 may also be comprised of active glass, polymer, or silicone in which the active material performs wavelength conversion or redirection. In the figure the outer envelope thickness is constant but through controlled variable thickness light beam control may be performed by the outer envelope as well. If serving only a passive function the outer envelope may comprise nano-structure such as moth-eye trees of wavelength scale to enhance anti-reflection properties and overall efficiency. Item 2 refers to the luminescent filament structure.

The luminescent filament structure 212 is comprised of either a phosphor loaded glass, glass-ceramic, or active polymer. Photonic crystalline structures may also perform wavelength conversion through the supercontinuum effect. Photonic-crystalline structures may also guide and direct light on the interior of the luminescent filament. The cladding of the luminescent filament in this embodiment constitutes the wavelength converter in which UV-Blue light is down converted to white light comprised of Green, Yellow, and Red. The luminescent filament structure 212 in this embodiment has five faces forming a tapered pentagon structure to further direct the light emission. The light emission "cladding" also has a tailored outer wall at the air or inert gas interface. The cladding shape serves to homogenize white light color temperature within the beam emission and to form the combination of indirect/direct light required to match the incandescent beam emission pattern of FIG. 2*c*. As such the novel luminescent filament structure 212 performs a dual purpose in that it converts wavelength and shapes light emission. The light received from the tapered "core" serves to pump the active cladding. Tapering angles are balanced to provide sufficient light field frustrated TIR properties as well as uniform pump excitation of the active cladding.

The lightpipe coupler region 213 transfers UV-Blue light from the combiner to the luminescent filament structure 212. A lightpipe field shaping device 214 in which light exiting the spider lightpipe network is converted from a rectangular illumination field to a circular or rotationally symmetric shape before transfer into the luminescent filament. The lightpipe shaping device 214 may be comprised of high transparency glass, polymer, or photonic band-gap cores or bundles. The lightpipe shaping device 214 may incorporate faceting features or ridges to further homogenize light.

The lightpipe combining section 215 directs light from the light emission cavities through the operation total internal reflection. Extended free-form t-splines, NURBS, or variations on the equiangular spiral are most efficient at directing the transfer of light with minimal loss. The thermal dissipation structures 216 channel heat from the LED or other solid state emitters to air. The thermal dissipation structures 216 are typically comprised of forged or cast aluminum or copper or other low thermal resistance alloys. The shape can be optimized using evolutionary algorithms to derive the appropriate structure to direct heat away and dissipate to the air in which natural convection dominates. The thermal dissipation structures may be painted black or textured and tapered depending on the flow fields. The glass envelope 211 may also give way to more thermal dissipation structures 216 at the cost of less indirect light and a comprise must be achieved in the interest of achieving the highest optical performance and beam pattern shaping.

The E26 base 217 retains a power electronics device, dimming circuit, and optical feedback control devices incorporated in the interior cavity. The power electronics devices producing the most heat may also be directly coupled to the thermal dissipation structures for the light generation engine.

Figure 22:
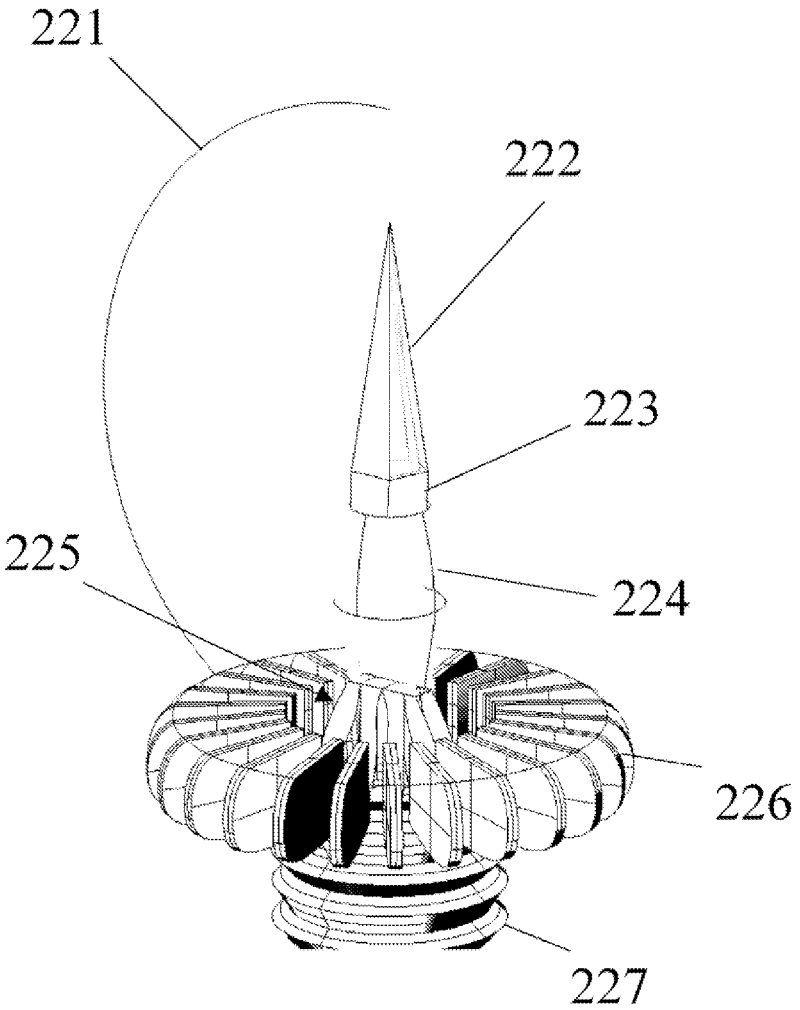
FIG. 22. illustrates a perspective view of the luminescent filament system incorporated into a G-25 lamp.

FIG. 22 is a perspective view of the luminescent filament system incorporated into a G-25 lamp. An envelope protection or active structure encloses a luminescent filament 222 comprised of five facets an active "cladding" and a tapered core; a lightpipe to filament combiner 223; a lightpipe transfer confocal elliptic concentrator 224 although the ellipse may be replaced by an extended free-form t-spline, T-NURCC, or D-NURBS structure; a lightpipe combiner 225 which pulls light from the light engine cavity arrangement to the transfer geometry; thermal dissipation structures 226 to channel heat away from the light engine and power electronics to the air; and an E26 base 227 which contacts to an Edison socket to provide power to the solid-state lamp. The glass envelope 221 may be tailored to allow for free-airflow through the dissipation structures as required. Power electronics, dimming circuitry, communication devices, or optical feedback control systems may be incorporated on the inside cavity of the contact base 227.

Figure 23:
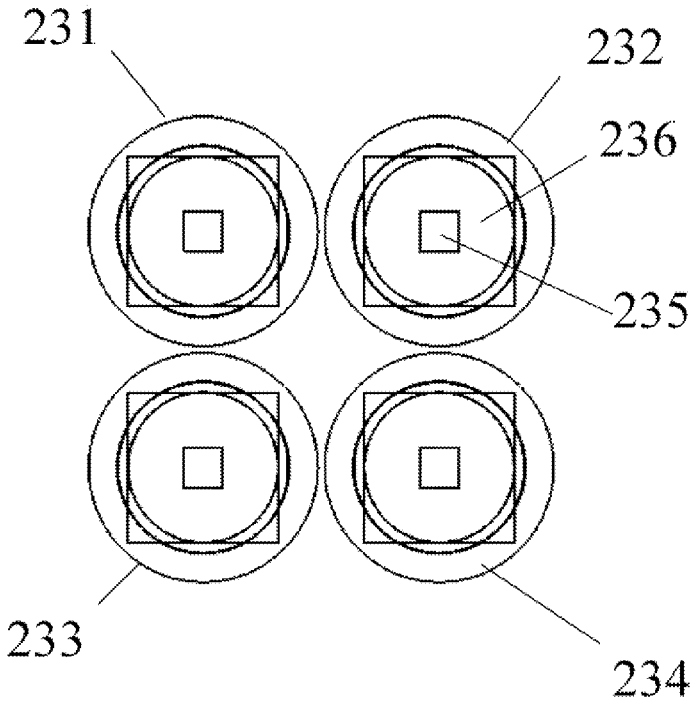
FIG. 23. illustrates a light emission cavity array comprised of 4 cavities with 1 emitter each.

FIG. 23 illustrates a light emission cavity array comprised of four cavities with one emitter each. Four light emission cavities 231, 232, 233, and 234 are arranged in a square or rectangular arrangement in a 2×2 arrangement although a linear 1×4 arrangement is also an alternative. Separation of the cavities serves to spread the heat sources out for better channeling to the thermal dissipation devices. More than one light emitter 235 may be placed in each cavity. The light emitter 235 may be a light emission device GaN UV-Blue, ZnO emitter, laser diode, or resonant-cavity LED. The light emitter 235 is secured to a substrate 236 upon which the light emitter 235 is attached preferably through a eutectic attachment material. The emission cavities 231, 232, 233, and 234 may be comprised of an overmolded lead frame composed of a highly reflective plastic, or a ceramic layered structure, or other glass filled composites.

Figure 24:
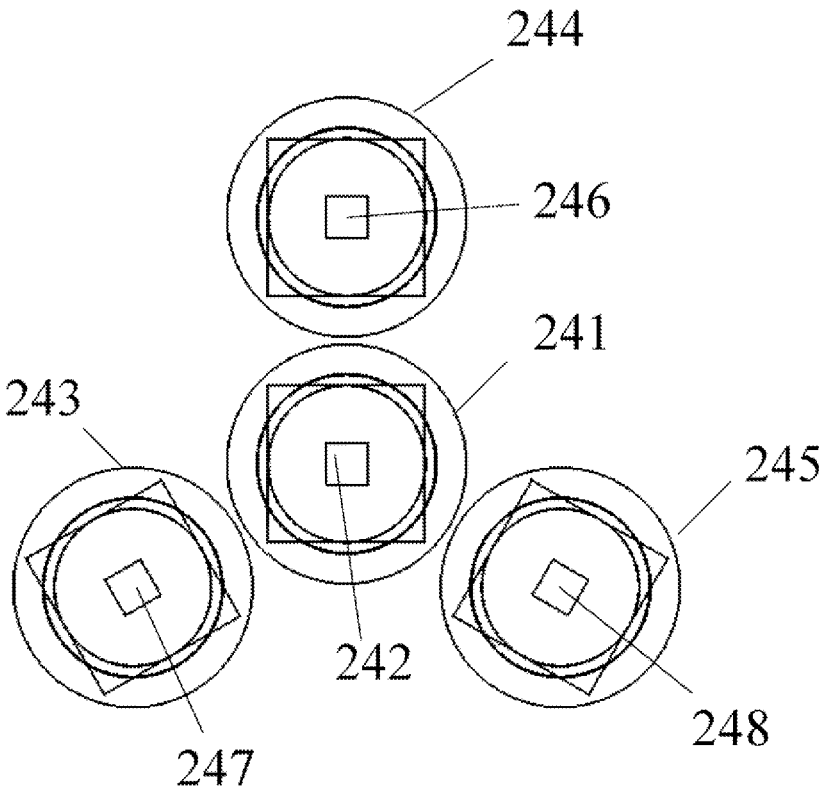
FIG. 24. illustrates a 4-cavity array in a triangular pattern with a central cavity.

FIG. 24 illustrates a four-cavity array in a triangular pattern with a central cavity 241. The light emission cavities comprise a triangular arrangement with a central light emission cavity 241. More than one light emitter 242 per cavity is also possible. The light emission cavities 241, 243, 244, 245 serve to supply power to the UV-Blue LED's, to encapsulate the emitters 242, 246, 247, 248 with silicone, or direct contact glass, in which a micro-particle loaded silicone or glass better extract light from the high index GaN or ZnO emitters. Blue light is not a limitation. UV-IR light emission devices may also be incorporated with combinations of direct emission and low stokes shift loss wavelength conversion. For example to boost CRI in the 2850K a direct emission red emitter may be incorporated in one of the cavities, or a blue may be converted to a red through nitride based phosphor applied directly to the blue or UV emitter, but preferably the wavelength conversion will occur in the luminescent filament section to eliminate thermal quenching.

Figure 25:
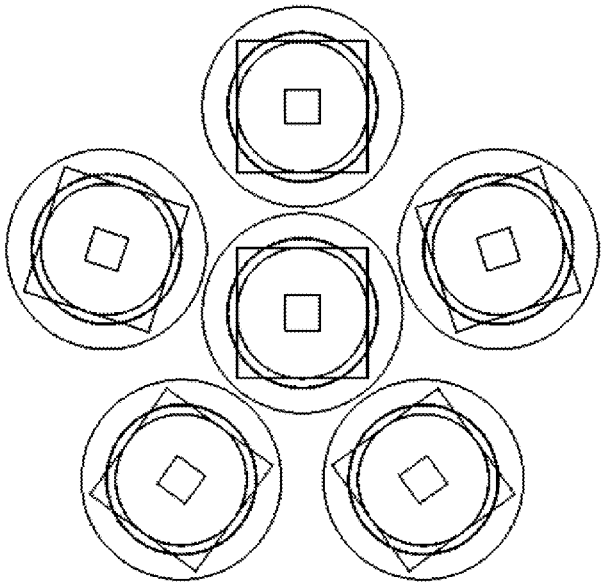
FIG. 25. illustrates a light emission cavity pattern comprised of 6 cavities in a star arrangement.

FIG. 25 illustrates a light emission cavity pattern comprised of six cavities in a star arrangement 250. The light emission cavities comprising this star arrangement may contain 1 to 12 light emitters each. The die structure themselves are preferably Copper substrate emitters in which the active structures are grown on GaN, Sapphire, or ZnO, then through a laser lift-off procedure taken away then bonded directly to a Cu substrate. This greatly enhanced thermal conduction from the active layer to the metal-core board, AlN interposer, or directly attached to the patterned and isolated thermal dissipation device preferably comprised of Cu or Al or other highly conductive alloy.

Figure 26:
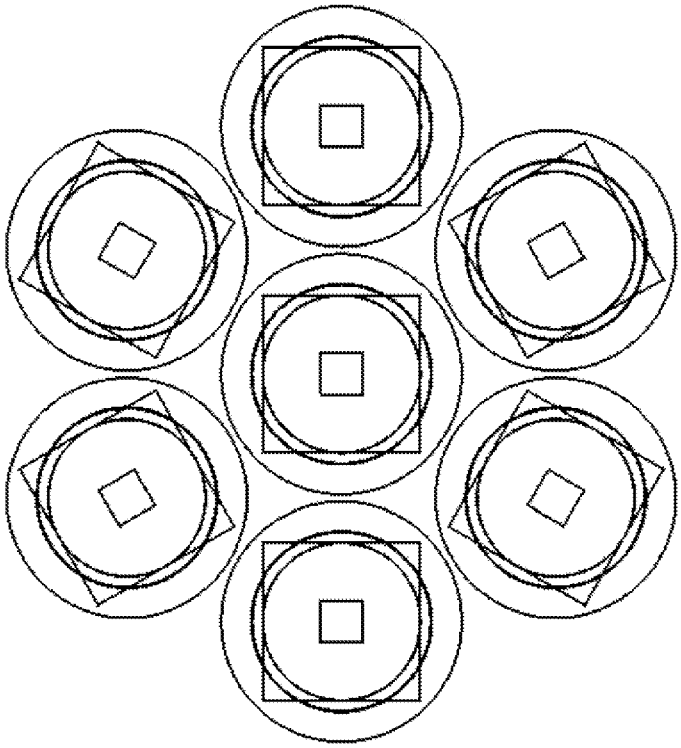
FIG. 26. illustrates a 7-cavity Light emission cavity array to pump the luminescent filament.

FIG. 26 illustrates a seven-cavity light emission cavity array 260 to pump the luminescent filament. The seven-cavity array of light emitting diodes, lasers, resonant cavity light emitters, or photonic crystal patterned amplified spontaneous emission devices. The light emission devices may be attached to a BeO, AlN, Cu, CuMo, or CuW, Al, or other substrate through InS, AuS, or CVD diamond attach material. Microchannels may be incorporated under the thermal dissipation device for air flow, water flow, or for heat piping in which a heat pipe transfers light from the heat source centers to the thermal dissipation devices cooling through radiation and natural convection.

Figure 27:
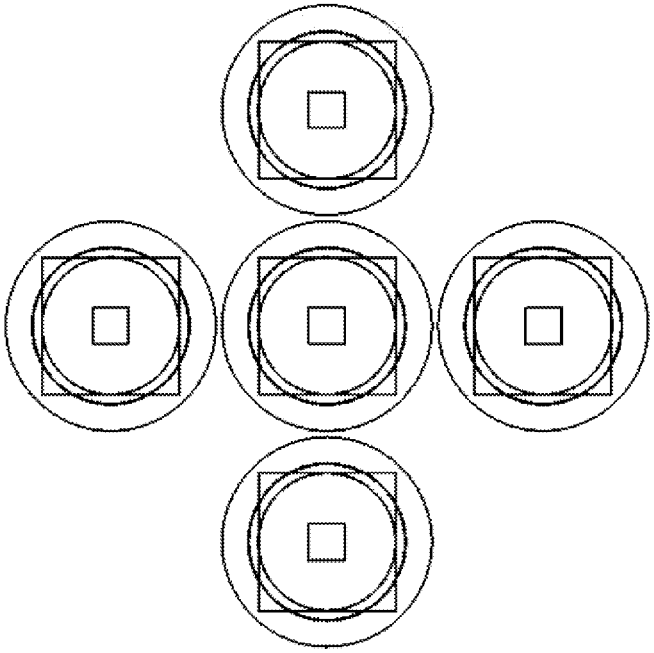
FIG. 27. illustrates a 5-cavity light engine array.

FIG. 27 illustrates a five-cavity light engine array 270. A five-cavity light emission array serves to apply power to the light emitting junction device, to extract light through encapsulation or direct glass attachment, and to protect the LED's.

Figure 28:
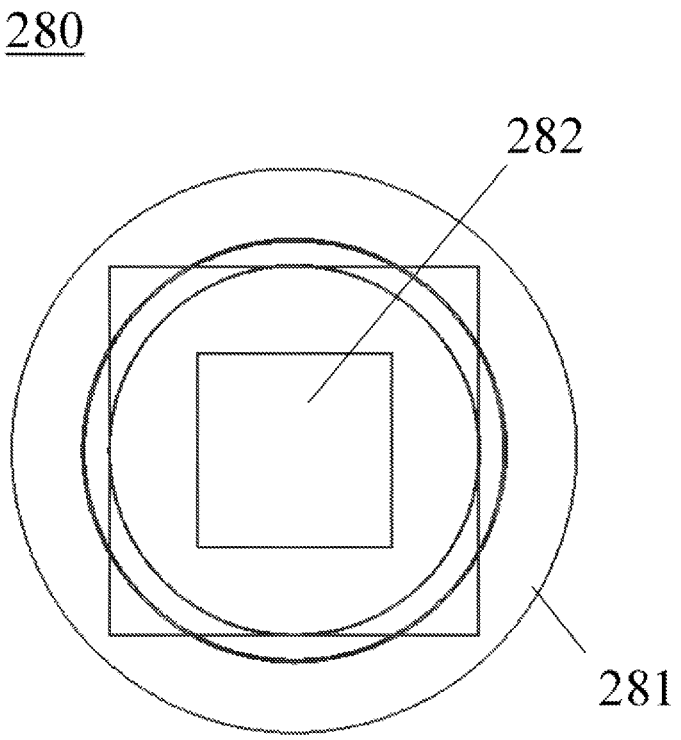
FIG. 28. illustrates a single light emission cavity with large solid state light producing device.

FIG. 28 illustrates a single light emission cavity 280 with large solid state light producing device 281. In this figure the light emission cavity is larger and contains a large light emitting diode 282 which may be up to 16 mm^2 in area. Vertical structure light emitters are preferred as they can produce light efficiently at larger cross-sectional area. The light emitting diode 282 may be either Cu substrate based or flip-chip in which the active structure is closest to the thermal dissipation structures allowing for more intimate contact of the lightpipe sections to the light emission device thereby reducing the cross-sectional area of the lightpipe required to capture and redirect the light through the operation of TIR waveguiding.

Figure 29:
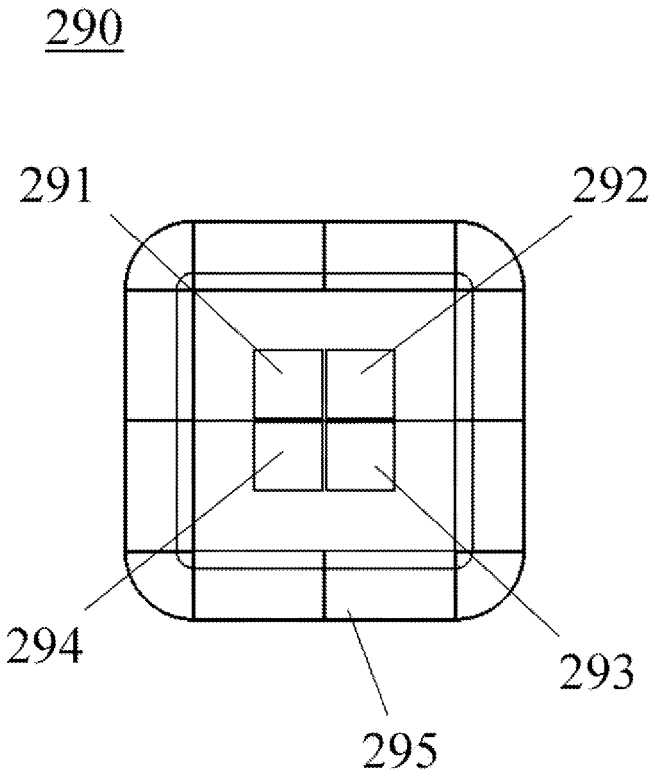
FIG. 29. illustrates a square single cavity with 4 die emitters.

FIG. 29 illustrates a square single cavity 290 with four die emitters 291, 292, 293, 294. In this embodiment the die emitters 291, 292, 293, 294 are placed close together to increase luminance in a single square cavity 290. The cavities may be filled with high index silicone or Sol-gel to extract light from the high index GaN, InGaN, and AlInGaN layers. AlGaInP emitters especially benefit from high index encapsulation to boost external quantum efficiency. The cavity structure 295 may be comprised of polythalamide or LCP a liquid crystal filled polymer.

Figure 30:
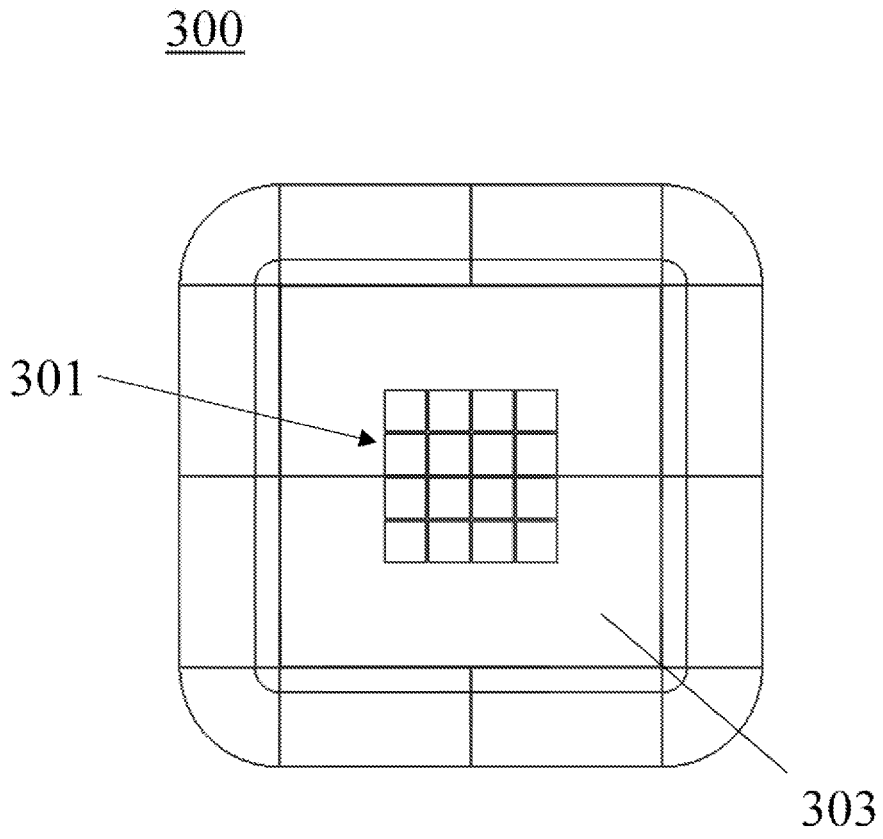
FIG. 30. illustrates a larger single light emission cavity with 16 emitters.

FIG. 30 illustrates a larger single light emission cavity 300 with sixteen emitters 301. A large single light emission cavity 300 filled with sixteen individual smaller emitters 301 which may be each 0.3-4 mm^2 in area. Vertical structure junctions are critical with close light emission packing. The sixteen emitters 301 also preferably are Cu substrate emitters or flip-chip structure. The interposer or sub-mount 303 is preferably comprised of Cu, AlN, Al, CuMo, or CuW.

Figure 31:
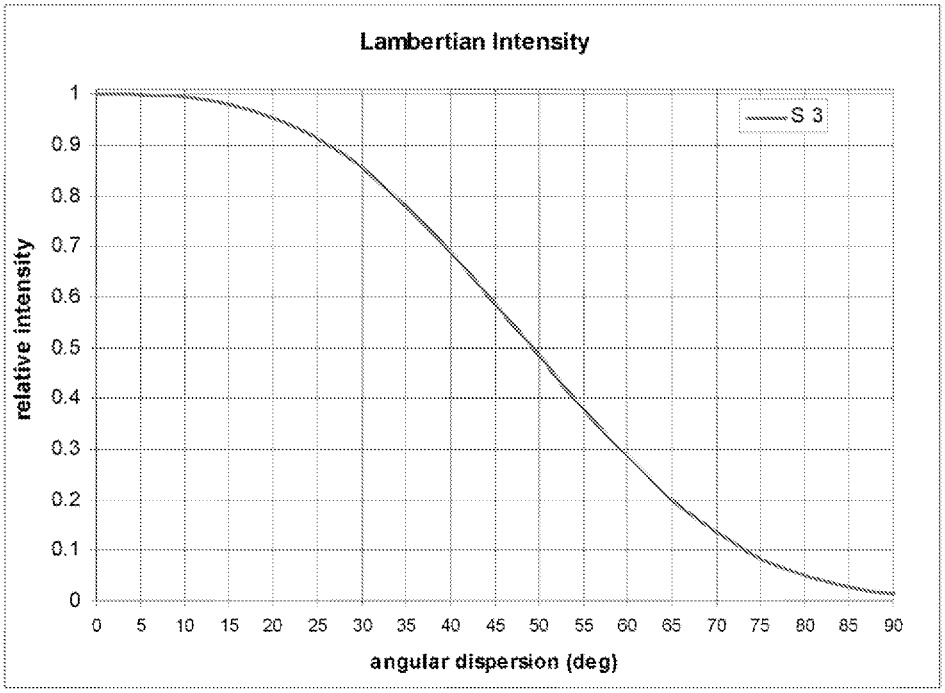
FIG. 31. illustrates an intensity distribution of typical light emitting diode.

FIG. 31 illustrates the intensity distribution of typical light emitting diode. A typical light emitting diode produces a lambertian intensity distribution. The equation shown in Table 1 describes the light fall off with angle with S factor=3. These light emitters source the lightpipes, which feed the luminescent filament or filaments. The disadvantage of a lambertian intensity emission is the required area to collimate and direct the light through TIR.

TABLE 1

$$I\{r\} = I_0 \exp\left\{-2\left(\frac{r}{w_S}\right)^S\right\},$$

| profile name | Lambertian Intensity | | |
|---|---|---|---|
| Io | 1 | | |
| ws | 0.5 | | |
| S | 3 | | |
| incrementer | 0.025 | | |
| start value | 0 | | |

Figure 32:
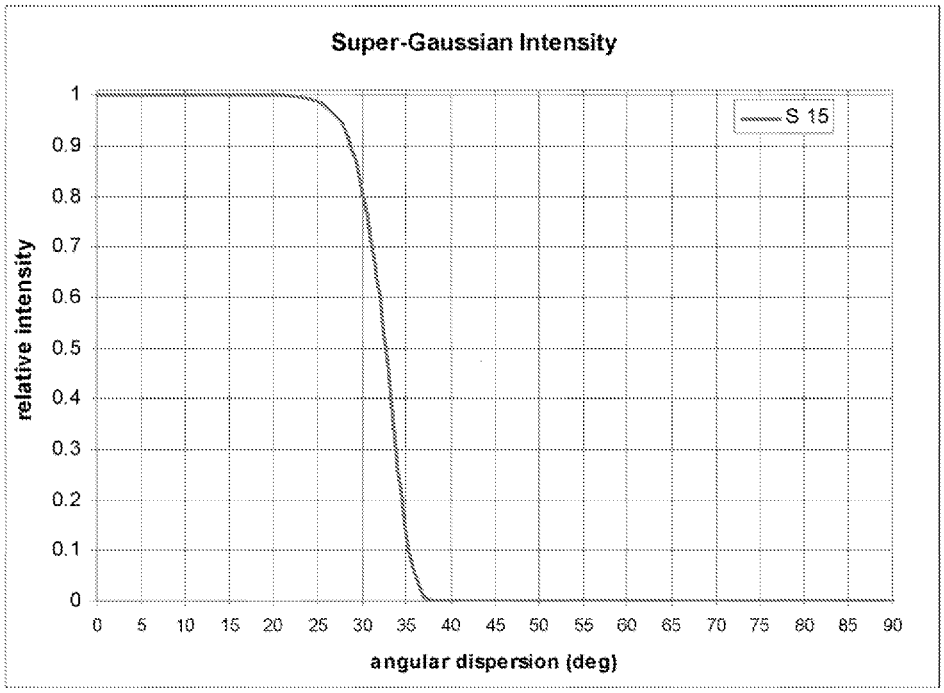
FIG. 32. illustrates a super-gaussian intensity distribution provided by photonic crystalline structures on light emitter.

Now referring to FIG. 32, a super-gaussian intensity distribution provided by photonic crystalline structures on light emitter is shown. The light emission profile shown in FIG. 31 is a super-gaussian intensity profile which provides for more uniform excitation of a luminescent ceramic chip, or for higher efficiency coupling to a lightguide. Lightguides when imperfectly manufactured contain micro-roughness which slightly degrades the operation of TIR over length reducing light transfer efficiency. It is highly advantageous to guide the light from the light emission devices with an efficiency greater than the thermal quenching loss which would have occurred with direct application of the wavelength conversion mechanisms. The light guidance devices should provide higher than 85% efficiency to produce an advantage. Glasses and polymers with internal transmittance higher than 98% are readily available. The super-gaussian beams described are used in the laser industry to pump active thin disk materials or second harmonic generation producing non-linear crystals.

The light emission structure of the quantum well layers is coupled to a photonic crystalline device which shapes the light emission profiles at high efficiency. Careful attention must be paid to reducing defects through HVPE growth on GaN, non-polar sapphire, or through exciton center isolation nano-pillars. Patterned substrates help induce ideal mode energy profiles, as do combinations of photonic-crystalline structure with nano-roughening on the top surface or nano-roughening of the cleaved edges.

TABLE 2

$$I\{r\} = I_0 \exp\left\{-2\left(\frac{r}{w_S}\right)^S\right\},$$

TABLE 2-continued

| profile name | Super-Gaussian Intensity | | |
|---|---|---|---|
| lo | 1 | | |
| ws | 0.5 | | |
| S | 15 | | |
| incrementer | 0.025 | | |
| start value | 0 | | |

Ideally >99% of the light should emit from the top surface with a super-gaussian light emission intensity distribution constituting an S value >12. An S value equal to fifteen is shown in Table 2. The half beam angular dispersion is also reduced from 50 degrees in FIG. 30 to 35 degrees in FIG. 31. This can enhance light transfer efficiency by 3-7% when using imperfect lightguiding structures to pull light from the light emission cavities to the luminescent filament device.

Furthermore, other areas of art may benefit from this method and adjustments to the design are anticipated. Thus, the scope of the invention should be determined by the appended claims and their legal equivalents, rather than by the examples given.

I claim:

1. A solid-state luminescent filament lamp comprising:

a. a glass envelope structure;

b. a source filament emitting device housed within the glass envelope structure;

c. a wavelength conversion shell connected to the source filament;

i. the wavelength conversion shell whose shape is specifically tailored to redirect light to produce an indirect, direct or omnidirectional source;

ii. an inner structure with a thickness to maximize light transfer efficiency, wavelength conversion efficiency, and to maintain constant color temperature in the beam intensity zones as desired; and iii. an inner core or injector where the blue light emerges from a lightguide network, frustrates TIR, and passes through the wavelength conversion shell before redirection;

d. the lightguide network comprised of high efficiency, low absorption glass, polymer, or photonic crystalline holey fiber structure which guides light from an emitter array and then injects light into the core connected to the wavelength conversion shell;

e. an emitter array coupled to the lightguide comprising an encapsulant immersing the emitter array;

f. thermal dissipation structures attached to the emitter array package structure creating an enclosed area;

g. a base attached to the thermal dissipation structures; and h. a power electronics device converting line AC to a stabilized power factor corrected DC to drive the solid-state emitter devices located within the base.

2. The solid-state luminescent filament lamp of claim 1 wherein, the source filament is a b-spline, polynomial, t-spline, T-NURCC, NURBS, or NSS described combination.

3. The solid-state luminescent filament lamp of claim 1 wherein, the source filament is a luminescent glass comprised of a fluoro-phosphate or oxy-sulphide halide glass doped with rare earths combined to produce a high CRI of at least 80 and a color temperature of 2700-6500K.

4. The solid-state luminescent filament lamp of claim 1 wherein, the wavelength conversion shell is comprised of a glass-ceramic loaded with rare earths combined to produce a high CRI of at least 80 and a color temperature of 2700-6500K.

5. The solid-state luminescent filament lamp of claim 1 wherein, the wavelength conversion shell produces wavelength conversion through a phosphor loaded polymer.

6. The solid-state luminescent filament lamp of claim 1 wherein, the wavelength conversion shell produces wavelength conversion through a photonic crystalline structure.

7. The solid-state luminescent filament lamp of claim 1 wherein, the power electronics device is further comprised of an optical feedback control providing means to avoid spectral shift over operation of the device lifetime, or to tune wavelength emitters to a desired color temperature.

8. The solid-state luminescent filament lamp of claim 1 comprising an E26, E27, E11, or E12 base.

9. The solid-state luminescent filament lamp of claim 1 wherein, the envelope structure contains moth eye nanostructure to reduce fresnel losses at both the incident and exit surfaces.

10. The solid-state luminescent filament lamp of claim 1 wherein, the envelope structure is comprised of glass or other material comprised of an active material altering wavelength conversion or light redirection.

11. A solid-state luminescent filament lamp comprising:

a. a glass envelope structure;

b. a source filament emitting device housed within the glass envelope structure;

c. a wavelength conversion shell connected to the source filament;

i. the wavelength conversion shell whose shape is specifically tailored to redirect light to produce an indirect, direct or omnidirectional source;

ii. an inner structure with a thickness to maximize light transfer efficiency, wavelength conversion efficiency, and to maintain constant color temperature in the beam intensity zones as desired; and iii. an inner core or injector where the blue light emerges from a lightguide network, frustrates TIR, and passes through the wavelength conversion shell before redirection;

d. the lightguide network comprised of high efficiency, low absorption glass, polymer, or photonic crystalline holey fiber structure which guides light from an emitter array and then injects light into the core connected to the wavelength conversion shell;

e. the emitter array coupled to the light guide comprising an encapsulant immersing the emitter array;

f. thermal dissipation structures attached to the emitter array package structure creating an enclosed area;

g. a base attached to the thermal dissipation structures; and h. a power electronics device converting line AC to a stabilized power factor corrected DC to drive the solid-state emitter devices located within the base;

i. a wavelength conversion shell surrounds a tapered pump core;

j. the wavelength conversion shell which itself is specifically tailored to optically control light distribution;

k. the lightguide network directs light to the luminescent filament structure;

l. a collimation device is directly coupled to the emitter array; and m. a package encloses the emitters in a high index encapsulant.

12. The solid-state luminescent filament lamp of claim 11, wherein:

the package encloses the emitters in a high index silicone encapsulant;

the silicone is loaded with higher index nano-particles of ZrO2, or Tantalum Pentoxide; and the emitters are nano-roughened or patterned with photonic crystalline structure to improve light transfer efficiency from the emitter array to the light guide network wherein the light guide network is an integral or monolithic light guide.

13. The solid-state luminescent filament lamp of claim 11, further comprising:

n. an efficient holey photonic band-gap light guide directs light from the emitter array to a wavelength conversion shell.

14. The solid-state luminescent filament lamp of claim 13, further comprising:

o. the solid-state emitter package coupled to a TIR lightguide.

15. The solid-state luminescent filament lamp of claim 11, comprising:

q. one central lightguide trunk or a high efficiency lightguide spider network in which the lightguide channels are comprised of T-splines or extended free-form geometry or equiangular spiral described lightguide sections which combine multiple cavities of light emitters.

16. The solid-state luminescent filament lamp of claim 11, wherein a super-gaussian beam emanates from the emitter array.

17. The solid-state luminescent filament lamp of claim 11, wherein a lambertian beam emanates from the emitter array.

18. The solid-state luminescent filament lamp of claim 11, further comprising:

y. a light emission cavity array comprised of four cavities arranged in a square or rectangular arrangement;

z. one or more light emitters placed in each cavity;

aa. said light emitters are secured to a substrate upon which the light emitter is attached; and bb. emission cavities comprised of an overmolded lead frame composed of a highly reflective plastic, or a ceramic layered structure, or other glass filled composites.

19. The solid-state luminescent filament lamp of claim 18, comprising a four-cavity array in a triangular pattern with a central cavity.

20. The solid-state luminescent filament lamp of claim 18, comprising:

cc. a six-cavity array in a star arrangement; and dd. said light emission cavities comprising this star arrangement containing one to twelve light emitters each.

21. The solid-state luminescent filament lamp of claim 18, comprising:

ee. a seven-cavity light emission cavity array;

ff. the light emission devices may be attached to BeO, AlN, Cu, CuMo, CuW, Al, InSn, AuSn, or CVD diamond attach material;

gg. microchannels incorporated under the thermal dissipation device for air flow, water flow, or for heat piping in which a heat pipe transfers light from the heat source centers to the thermal dissipation devices cooling through radiation and natural convection.

22. The solid-state luminescent filament lamp of claim 18, comprising a five-cavity light engine array to apply power to a light emitting junction device, to extract light through encapsulation or direct attachment.

23. The solid-state luminescent filament lamp of claim 18, comprising:

hh. a single light emission cavity; and ii. a light emitting diode is either Cu substrate based or flip-chip in which the active structure is closest to the thermal dissipation structures allowing for more intimate contact of the lightguide sections to the light emission device thereby reducing the cross-sectional area of the lightguide required to capture and redirect the light through the operation of TIR lightguiding.

24. The solid-state luminescent filament lamp of claim 18, comprising:

jj. the square single cavity with four die emitters;

kk. the die emitters are placed close together to increase luminance in a single square cavity;

ll. the cavity is filled with high index silicone or Sol-gel to extract light from the high index GaN, InGaN, and AlInGaN layers;

mm. the cavity structure is comprised of polythalamide or LCP a liquid crystal filled polymer.

25. The solid-state luminescent filament lamp of claim 24, comprising:

nn. a larger single light emission cavity with sixteen emitters;

oo. the sixteen emitters are Cu substrate emitters or flip-chip structure; and pp. an interposer or sub-mount is preferably comprised of Cu, AlN, Al, CuMo, or CuW.

* * * * *